US005187818A

United States Patent [19]

Barrett, Sr. et al.

[11] Patent Number: 5,187,818

[45] Date of Patent: Feb. 23, 1993

[54] FLUSHING SYSTEM FOR A WATER CLOSET

[76] Inventors: John P. Barrett, Sr., 879 Harbor Island, Clearwater, Fla. 33515; Daniel M. Thorsen, 3367 Brian Rd. North, Palm Harbor, Fla. 34685; John H. Johnson, Rte. 8, Box 274, DeFuniak Springs, Fla. 32433

[21] Appl. No.: 699,955

[22] Filed: May 14, 1991

[51] Int. Cl.[5] ..... E05D 1/00; E05D 1/14

[52] U.S. Cl. ..... 4/313; 4/DIG. 3; 4/324; 4/406; 4/304

[58] Field of Search ..... 4/313, 302, 305, 324, 4/406, 415, 304, DIG. 3

[56] References Cited

U.S. PATENT DOCUMENTS

| | | | |
|---|---|---|---|
| 1,391,676 | 9/1921 | Finley | 137/112 |
| 2,265,108 | 12/1941 | Berman | 122/13.1 |
| 2,614,576 | 10/1952 | Taylor | 137/122 |
| 2,693,826 | 11/1954 | Vaughan et al. | 137/637.2 |
| 2,912,994 | 11/1959 | Mori | 137/98 |
| 2,969,923 | 1/1961 | Fremion | 239/415 |
| 2,999,191 | 9/1961 | Muradian et al. | 361/195 |
| 3,123,065 | 3/1964 | Conley | 126/362 |
| 3,162,210 | 12/1964 | Bemis | 137/218 |
| 3,199,118 | 8/1965 | Moschetta et al. | 4/325 |
| 3,414,018 | 12/1968 | Eversman | 137/597 |
| 3,437,098 | 4/1969 | Stark et al. | 137/12 |
| 3,581,984 | 6/1971 | Buechner | 236/12 |
| 3,721,386 | 3/1973 | Brick et al. | 236/12 A |
| 3,776,261 | 12/1973 | Houghton | 137/337 |
| 3,779,181 | 3/1974 | Maddren | 137/1 |
| 3,843,978 | 10/1974 | Ragot | 4/73 |
| 3,846,847 | 11/1974 | Tufts et al. | 4/95 |
| 3,859,619 | 1/1975 | Ishihara et al. | 340/238 |
| 3,870,228 | 3/1975 | Moseley, Jr. | 237/59 |
| 3,908,204 | 9/1975 | Hopkins | 4/324 |
| 3,965,492 | 6/1976 | Hendricks | 4/79 |
| 4,141,091 | 2/1979 | Pulvari | 4/313 |
| 4,160,461 | 7/1979 | Vataru et al. | 137/337 |
| 4,199,118 | 4/1980 | Tetro | 242/745.44 |
| 4,233,694 | 11/1980 | Janosko et al. | 4/542 |
| 4,380,091 | 4/1983 | Lively | 4/508 |
| 4,392,260 | 7/1983 | Bensen | 4/324 |
| 4,406,401 | 9/1983 | Nettro | 236/12.12 |
| 4,409,694 | 10/1983 | Barrett et al. | 4/545 |
| 4,421,269 | 12/1983 | Ts'ao | 236/12.12 |
| 4,450,829 | 5/1984 | Morita et al. | 126/362 |
| 4,508,261 | 4/1985 | Blank | 236/20 R |
| 4,570,272 | 2/1986 | Kawaguchi et al. | 4/302 |
| 4,624,017 | 11/1986 | Foletta | 4/304 |
| 4,635,844 | 1/1987 | Barrett et al. | 236/12.12 |
| 4,667,350 | 5/1987 | Ikenaga et al. | 4/304 |
| 4,700,884 | 10/1987 | Barrett et al. | 236/12.12 |
| 4,742,583 | 5/1988 | Yoshida et al. | 4/313 |
| 4,753,265 | 6/1988 | Barrett et al. | 137/554 |
| 4,870,986 | 10/1989 | Barrett et al. | 137/119 |
| 4,908,886 | 3/1990 | Barrett et al. | 4/325 |
| 5,036,553 | 8/1991 | Sanderson | 4/313 |

FOREIGN PATENT DOCUMENTS

| | | | |
|---|---|---|---|
| 642360 | 6/1962 | Canada . | |
| 0084131 | 7/1983 | European Pat. Off. . | |
| 4635 | 1/1977 | Japan | 4/302 |
| 223231 | 9/1989 | Japan | 4/313 |
| 2165271 | 4/1986 | United Kingdom | 4/406 |
| 80/00984 | 5/1980 | World Int. Prop. O. . | |

*Primary Examiner*—Henry J. Recla
*Assistant Examiner*—Keith Kupferschmid
*Attorney, Agent, or Firm*—Frijouf, Rush & Pyle

[57] ABSTRACT

An apparatus and method for an improved flushing system for flushing a water closet from a pressurized water line includes sensor which senses an arrival and a departure of a person within a zone proximate the water closet. A controller is connected to the sensor for determining the existence of a low water volume flush condition and the existence of a high water volume flush condition. The low water volume flush condition exists when the sensor senses an elapsed time between the arrival and the departure of less than a preselected time interval. The high water volume flush condition exists when the sensor senses an elapsed time greater than the preselected time interval.

18 Claims, 13 Drawing Sheets

FLUSHING SYSTEM FOR A WATER CLOSET

BACKGROUND OF THE INVENTION

1. Field Of The Invention

This invention relates to water conservation in water closets, and more particularly to devices which automatically flush water closets.

2. Information Disclosure Statement

Many parts of the United States and other countries are facing severe water shortages. Water restrictions and rationing are becoming commonplace in many areas. Some communities have even imposed outright bans on lawn-watering, car washing, and other non-critical water-utilizing activities. These shortages have raised a number of questions about current water usage practices. One of these questions concerns water closet usage.

The standard tank-type water closet utilizes approximately 3.5 to 7.0 gallons of water for each flush. As such, it is a major consumer of fresh water in homes and commercial establishments. Conservation of the water usage of this appliance can have a significant impact on the overall water problem in many areas. As such, improvements on the water closet which minimize water usage with each flush are both socially desirable and economically viable. One way to minimize water usage is to provide flushes of various lengths depending on the contents to be purged from the water closet.

Prior art discloses such water closets. In a prior patent, U.S. Pat. No. 4,908,886 to Barrett, Sr. et al. (1990), a system was disclosed for controlling the flow of a liquid from a liquid pressure line for flushing a toilet bowl. The device included a valve interconnecting the liquid pressure line and the toilet bowl. An electrical control generated a first and second timer period with the second timer period being longer in duration than the first timer period. The electrical control was connected to the valve for opening the valve for the first timer period for flushing a liquid waste from the toilet bowl and for opening the valve for the second timer period for flushing a solid waste from the toilet bowl.

This and similar devices significantly enhance the cause of water conservation by allowing the user to select a short flush when only a liquid waste is to be removed, and to select a longer flush when a solid waste is to be removed. However, these devices do not flush the water closet automatically. The user must manually actuate the flush mechanism. Automatic flushing can provide many advantages.

As the population of the country ages, many people encounter difficulty in performing routine functions which had previously been considered simple and convenient. While flushing a standard water closet by depressing the conventional handle may be considered a minimal-effort task by most, it can be difficult for those infirm or with limited mobility. Automatic flushing offers greater convenience by flushing automatically after each use, thus assisting those people and others by relieving them of that effort. Additionally, a water closet which flushes automatically increases sanitation by insuring that the water closet will be flushed after each use. This is especially useful in public facilities which experience frequent use.

The prior art has used sensors for the automatic sensing of the presence of a person. For example, a wall-mounted sensor has been placed in the proximity of a urinal. The wall mounted sensor senses the presence of the person in front of the sensor, and flushes the urinal when the person departs. This prior art device greatly enhanced the convenience and sanitation associated with the use of these fixtures. However, this prior art device did not offer variable flush lengths for conserving water, and did not distinguish between various conditions under which various flush lengths would be desired.

Another way to reduce water usage is by use of pressure type water closets in place of the gravity or tank-type water closets. The pressure-type units utilize higher water pressure than the tank-type units, thus requiring less water to purge the water closet of the contents. Further, a high pressure flush is more effective in cleaning solid material in the water closet, resulting in a more sanitary and aesthetically pleasing condition. Some communities are now beginning to mandate through legislation the use of pressure-type water closets in place of tank-type water closets. As such, it is highly desirable to incorporate pressure-type water closets in any water conservation device. As such, it is further necessary to adapt the pressure-type water closets so that the pressure-type water closets can be widely and conveniently used.

One disadvantage of the pressure-type water closets is that the pressure-type water closets require a fixed minimal water pressure and water volume to operate effectively. Due to the low water pressure of a local water system, or due to the small pipe size supplying water to a particular location, the water pressure and water volume at a water closet may be insufficient to operate a pressure-type system. As such, features such as a pressurized water reservoir to enhance the water flow into the water closet are needed to overcome this problem.

Therefore, it is an object of the present invention to provide an improved flushing system which both minimizes water usage on each flush thereby conserving water, and does so automatically such that no user intervention is required.

Another object of the present invention is to provide an improved flushing system which detects and distinguishes between a liquid waste and a solid waste and which removes the waste automatically with a minimal amount of water.

Another object of this invention is to provide an improved flushing system which automatically flushes a water closet with water, providing greater convenience to the user, and increased sanitation due to the assurance that the water closet will be flushed after each use.

Another object of this invention is to provide an improved flushing system which provides a higher pressure flush which is more effective in cleaning solid material in the water closet, resulting in a more sanitary and aesthetically pleasing condition.

Another object of this invention is to provide an improved flushing system for enhancing the flow of water into the water closet in those locations where low water pressure conditions exist.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved method and apparatus for flushing a water closet with a flow of water from a pressurized water line after use by a person.

A sensor is mounted relative to the water closet for sensing an arrival of the person within a zone and a departure of the person from the zone. The zone is located in a preselected proximity relative to the water closet, and includes an area which is occupied by the person when seated upon the water closet or when standing immediately adjacent the water closet. Preferably, the sensor comprises an infrared sensor and provides an arrival signal when the sensor senses the person arriving within the zone, and provides a departure signal when the sensor senses the person departing from the zone.

A controller is connected to the sensor for receiving the arrival and departure signals, and for determining the existence of a short-flush condition and the existence of a long flush condition. The short-flush condition exists when the departure is sensed by the sensor, and an elapsed time between the arrival and the departure is less than a preselected time interval. The long-flush condition exists when the departure is sensed by the sensor, and the elapsed time is greater than the preselected time interval. Preferably, the preselected time interval is established to be approximately fifty seconds. However, an adjustment means may be provided for adjusting the preselected time interval. The controller determines the arrival of the person within the zone, determines the departure of the person from the zone, measures the elapsed time between the arrival and the departure, and compares the elapsed time to the preselected time interval, thereby determining the existence of the short-flush condition or the long-flush condition. Preferably, the controller includes a presence timer for measuring the elapsed time.

A valve is interposed between the pressurized water line and the water closet. The valve has an open position for enabling the flow of water into the water closet and has a closed position for inhibiting the flow of water into the water closet.

An actuator, preferably electrically operated, is connected to the valve and the controller for moving the valve into the open position for a first duration when the controller determines the existence of the short-flush condition, and for returning the valve into the closed position. The actuator moves the valve into the open position for a second duration when the controller determines the existence of the long-flush condition, and returns the valve to the closed position. The first duration is established to be commensurate with an amount of time required to remove a liquid waste. The second duration is established to be commensurate with an amount of time required to remove a solid waste. The first duration is less than the second duration. Preferably, means for adjusting the first duration and the second duration are also provided.

A first volumetric flow of water produced upon the movement of the valve into the open position for the first duration is less than a second volumetric flow of water produced upon the movement of the valve into the open position for the second duration. The first volumetric flow is for flushing a liquid waste and the second volumetric flow is for flushing a solid waste.

Preferably, the controller also comprises a flushing timer for determining that either a first duration has elapsed or that the second duration has elapsed.

In the preferred embodiment, the valve has a valve input and a valve output. A first connection means, preferably a first conduit, connects the valve input to the pressurized water line. A second connection means, preferably a second conduit, connects the valve output to the water closet. An actuator is connected to the valve for moving the valve between the open position and the closed position.

In one embodiment of the invention, a closed reservoir having a reservoir aperture is connected to the valve input and the pressurized water line through the first connection means and is in fluid communication with the valve input and the pressurized water line through the reservoir aperture. Preferably, the valve, the first conduit, and the second conduit have a valve diameter, a first conduit diameter and a second conduit diameter, respectively. Each of the valve diameter, the first conduit diameter and the second conduit diameter is greater than a diameter of the reservoir aperture. In addition, each of the valve diameter, the first conduit diameter and the second conduit diameter is substantially greater than the intake diameter of the pressurized water line. This relationship of diameters insures that the valve diameter, not impede the flow of water from the closed reservoir and the pressurized water line into the water closet.

The closed position of the valve inhibits the flow of water into the water closet, and enables the flow of water from the pressurized water line into the closed reservoir through the reservoir aperture and to be maintained therein. The open position of the valve enables the flow of water from the pressurized water line into the water closet, and enables the water retained in the closed reservoir to flow simultaneously into the water closet thereby assisting the flow of water from the pressurized water line in flushing the water closet.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
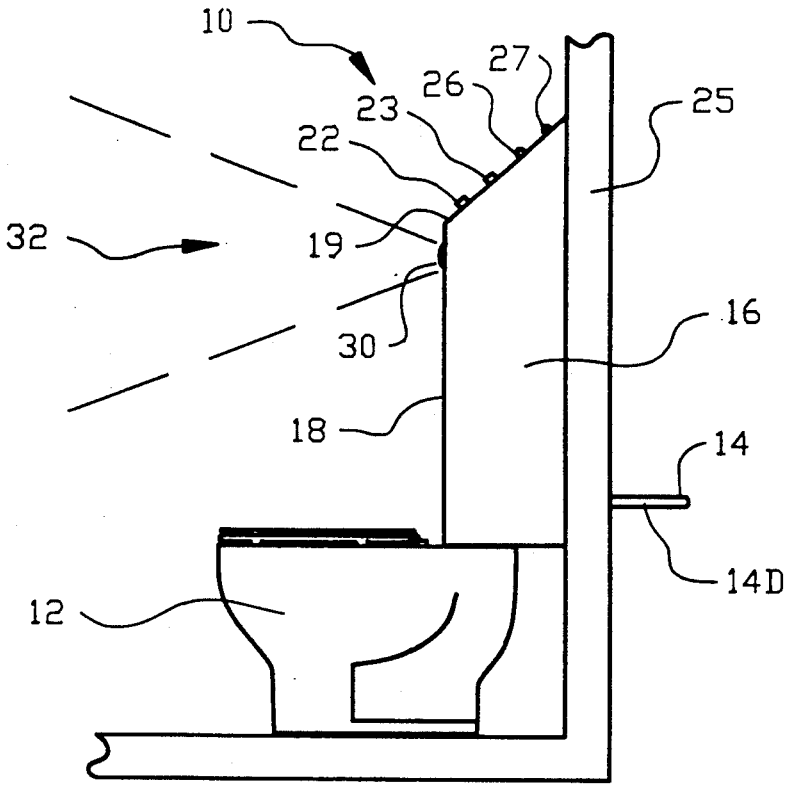
FIG. 1 is a side view of a first embodiment of an improved flushing system mounted on a water closet.
Figure 2:
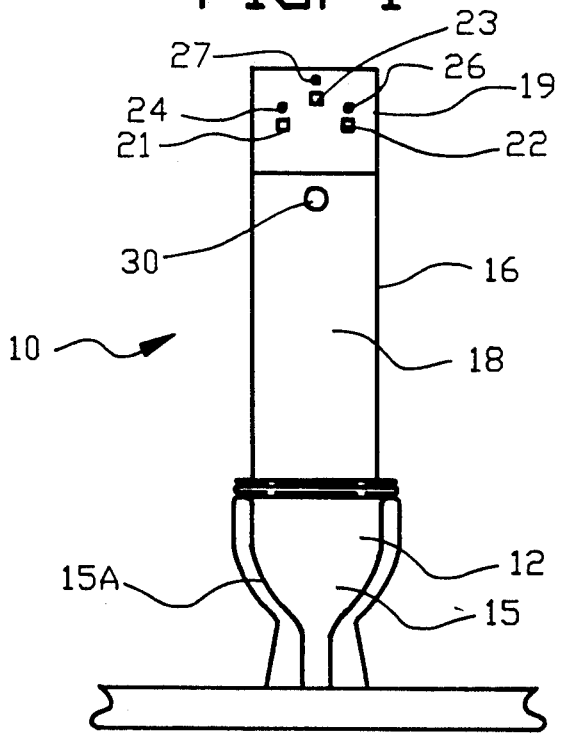
FIG. 2 is a front view of FIG. 1 partially in section illustrating an improved coating disposed on the interior of the water closet.
Figure 3:
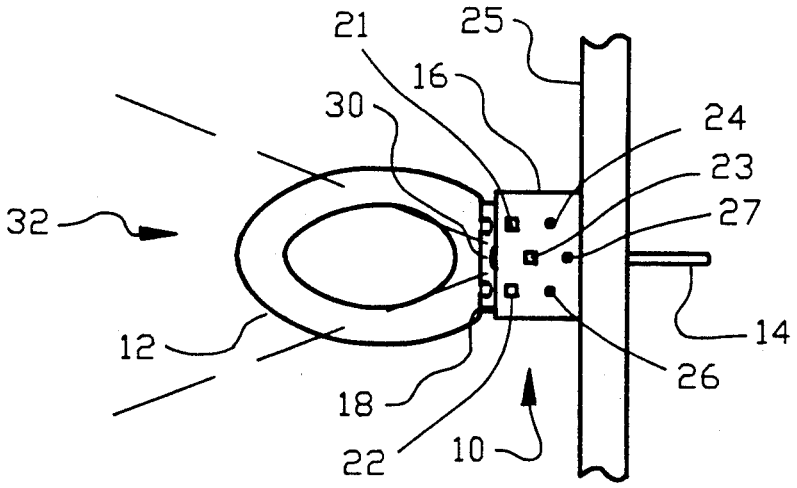
FIG. 3 is a top view of FIG. 1.

FIGS. 1-3 are side, front and top views of an improved apparatus, shown generally as 10, for flushing a water closet 12 with a flow of water from a pressurized water line 14 having an intake diameter 14D. The pressurized water line 14 may emanate from a conventional public water line or may be produced by an elevated reservoir. Preferably, the water closet 12 has a low volume bowl 15 enabling the water closet to purge the bowl 15 with a minimum water volume.

As best shown in FIG. 2, the low volume bowl 15 of the water closet 12 may be coated with a non-stain, non-stick surface coating 15A for facilitating the removal of solid water from the bowl 15 during flushing. The non-stick surface coating 15A may be a coating such as TEFLON, DELRIN or the like.

The apparatus 10 is mounted upon the water closet 12 and is secured to a wall 25. The apparatus 10 is enclosed in a housing 16 having a front 18 and a top 19. A manual control means is shown as a number one button 21, a number two button 22, and an automatic/manual button 23 mounted on the top 19 of the housing 16. An automatic light emitting diode (LED) 24, a manual light emitting diode (LED) 26 and an active light emitting diode (LED) 27 are also mounted on the top 19 of the housing 16. A sensor 30 is shown protruding through the front 18 of the housing 16 of the apparatus 10. A zone shown generally as 32 is located in preselected proximity to the water closet 12.

FIGS. 4-9 are side cut-away representations of the apparatus 10. A controller 40 is mounted within the housing 16. The number one button 21, the number two button 22, the automatic/manual button 23, the automatic light emitting diode (LED) 24, the manual light emitting diode (LED) 26 and the active light emitting diode (LED) 27 protrude through the top 19 of the housing 16 and are electrically connected to the controller 40. The sensor 30 is also electrically connected to the controller 40 as represented by line 34. A flushing timer 43 is incorporated into the controller 40 for controlling the duration of the flush and accordingly the volume of water use in the flush. Means for adjusting the duration of the flush, shown as an increment button 41 and a decrement button 42 are mounted on the controller 40 within the housing 16.

A presence timer 44 is contained within the controller 40 for establishing a preselected time interval of presence by a person. Means for adjusting the preselected presence time interval, shown as an increment button 46 and a decrement button 47 are mounted on the controller 40 within the housing 16.

An actuator shown generally as 50 is mounted internal the housing 16 and is electrically connected to the controller 40 by line 45. The actuator 50 includes a valve 60 mechanically connected to the actuator 50 with the valve 60 having a valve input 61 and a valve output 62. The valve 60 has a valve diameter 60D. A first conduit 65 connects the valve input 61 of the valve 60 to the pressurized water line 14. The first conduit 65 has a first conduit diameter 65D. A second conduit 66 connects the valve output 62 of the valve 60 to the water closet 12. The second conduit has a second conduit diameter 66D. The valve 60 is shown in a closed position in FIGS. 4, 5A–B, 6A–B, 8 and 9 and is shown in an open position in FIGS. 7A–B.

A reservoir pipe 70 is mounted vertically within the wall 25. The reservoir pipe 70 has a first end 71, a second end 72 and a reservoir pipe diameter 70D. The reservoir pipe diameter 70D defines a reservoir pipe aperture 70A at the first end 71 of the reservoir pipe 70. The first end 71 of the reservoir pipe 70 is mounted in fluid communication with the first conduit 65. Sealant means shown as a cap 74 is mounted to seal the second end 72 of the reservoir pipe 70.

The valve diameter 60D, the first conduit diameter 65D and the second conduit diameter 66D are equal to or greater than the reservoir pipe aperture 70A and substantially greater than the intake diameter 14D of the pressurized water line 14. The reservoir pipe aperture 70A is greater than the intake diameter 14D of the pressurized water line 14. Preferably, the cross-sectional area of each of the valve diameter 60D, the first conduit diameter 65D and the second conduit diameter 66D is at least equal to the combined cross-sectional area of the reservoir pipe aperture 70A and the pressurized water line 14.

Figure 4:
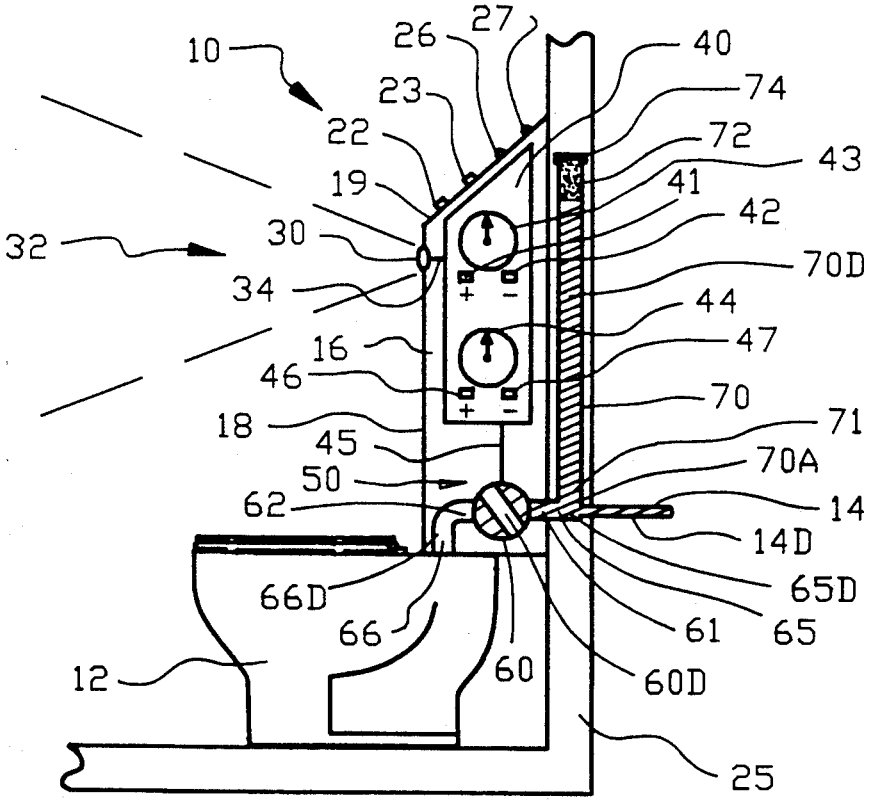
FIG. 4 is a partial cut-away view of FIG. 1.

FIG. 4 is a representation of the apparatus 10 wherein the sensor 30 is observing the zone 32 defined in preselected proximity to the water closet 12. FIGS. 5A–B and 6A–B show a person 55 in relative proximity to the apparatus 10.

Figure 5A:
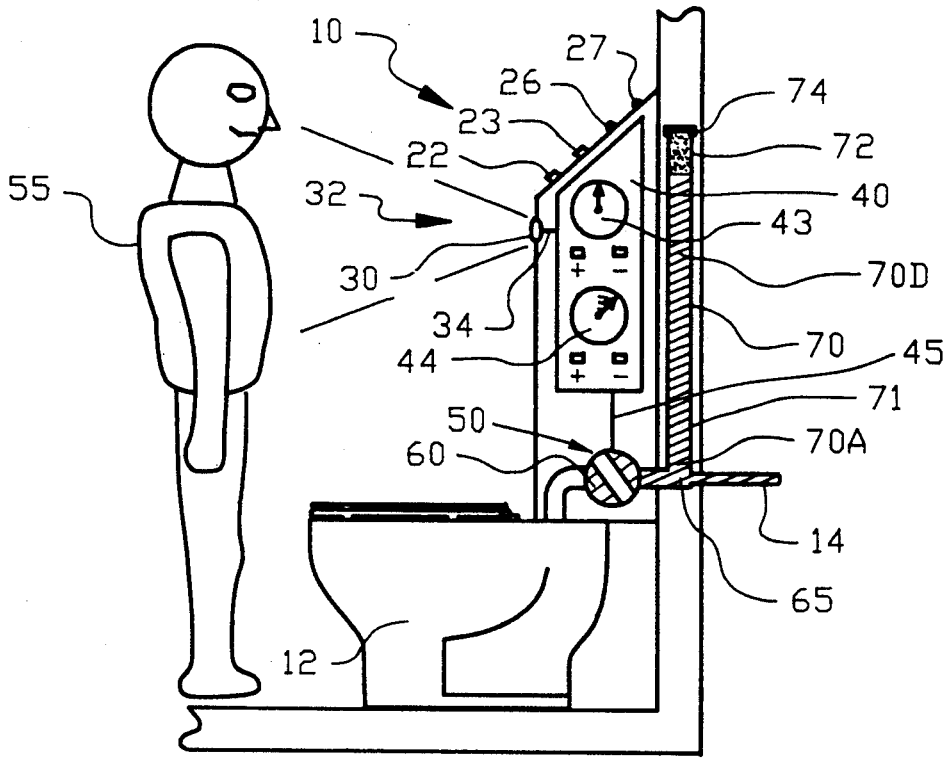
FIG. 5A is a representation of the operation of the improved flushing system upon the arrival of a standing person.
Figure 5B:
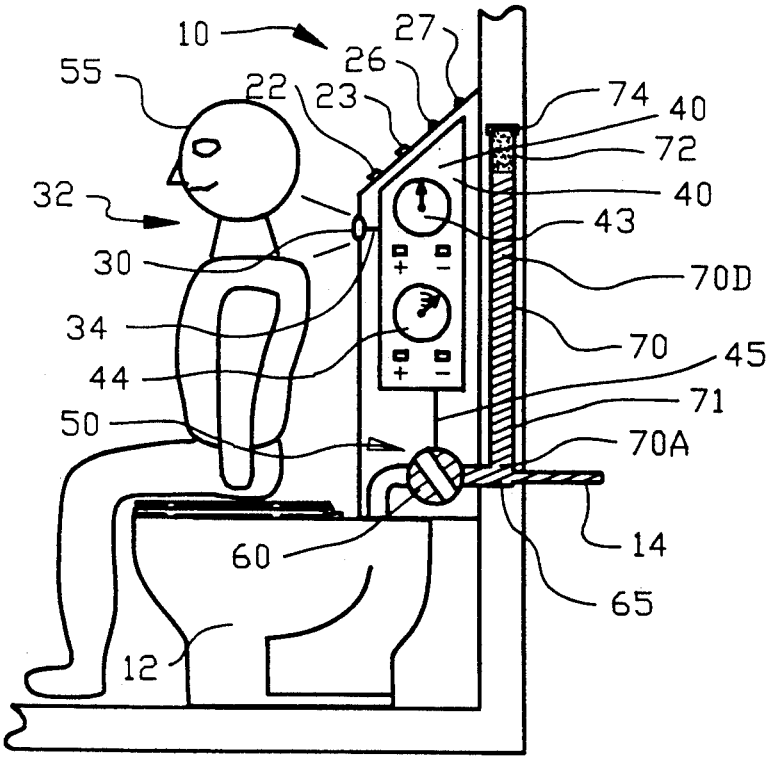
FIG. 5B is a representation of the operation of the improved flushing system upon the arrival of a sitting person.

FIG. 5A shows the arrival of the person 55 within the zone 32. FIGS. 5A and 5B show that the zone 32 includes that area occupied by the person 55 when standing immediately adjacent to or sitting upon the water closet 12. Preferably, the sensor 30 utilizing infrared sensing detects the arrival of the person 55 and sends an arrival signal to the controller 40 to start the presence timer 44.

Figure 6A:
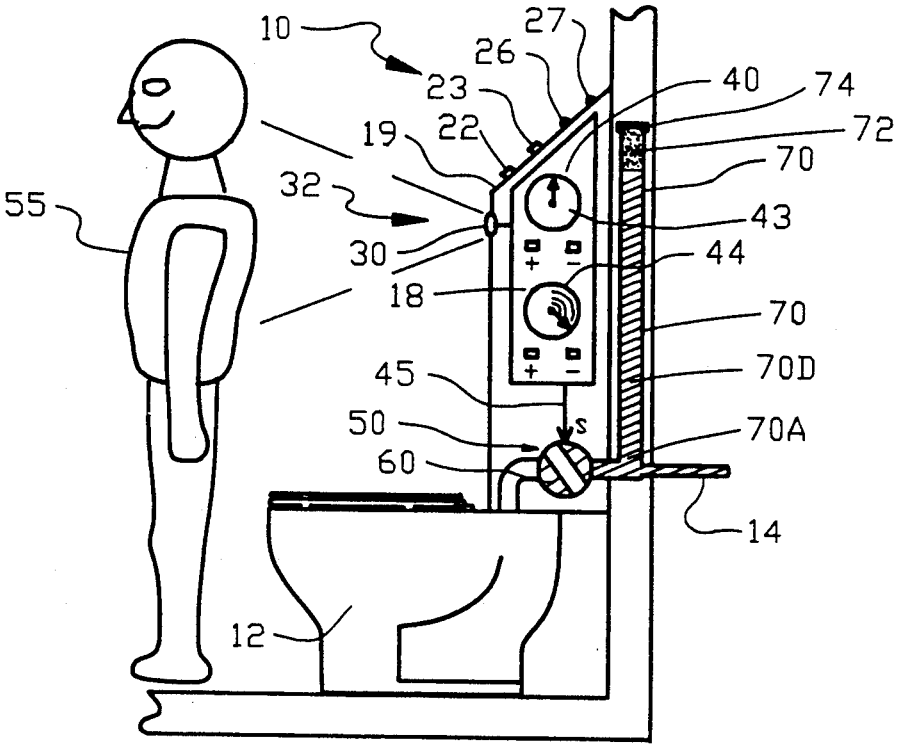
FIG. 6A is a representation of the operation of the improved flushing system upon the departure of a standing person.
Figure 6B:
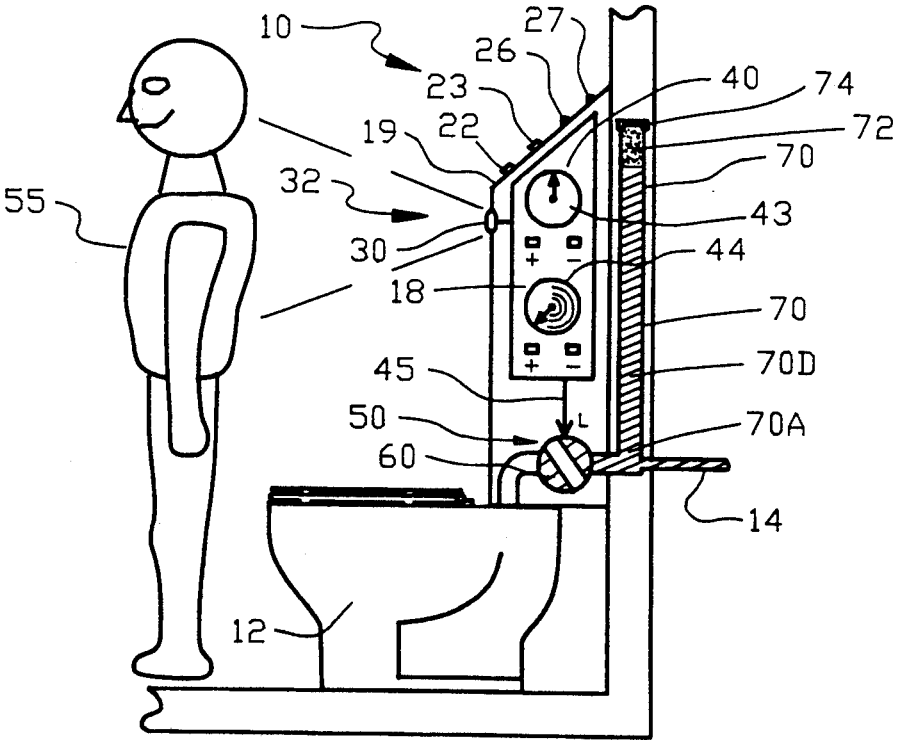
FIG. 6B is a representation of the operation of the improved flushing system upon the departure of a sitting person.

As shown in FIGS. 6A–B, the sensor 30 subsequently detects the departure of the person 55 and sends a departure signal to the controller 40 to stop the presence timer 44. The controller 40 measures the elapsed time recorded on the presence timer 44 between the receipt of the arrival signal and the receipt of the departure signal. The controller 40 compares the measured elapsed time to a preselected time interval and determines whether the measured elapsed time is greater than the preselected time interval or less than the preselected time interval. The preselected time interval can be adjusted by the adjustment means 46 and 47. Preferably, the preselected time interval is established to be approximately fifty-one seconds. If the controller 40 determines that the measured elapsed time is less than fifty-one seconds, a short-flush condition is determined to exist and a short-flush signal is sent on line 45 to the actuator 50 as shown in FIG. 6A. If the controller 40 determines that the measured elapsed time is greater than fifty-one seconds, a long-flush condition is determined to exist and a long-flush signal is sent on line 45 to the actuator 50 as shown in FIG. 6B.

Figure 7A:
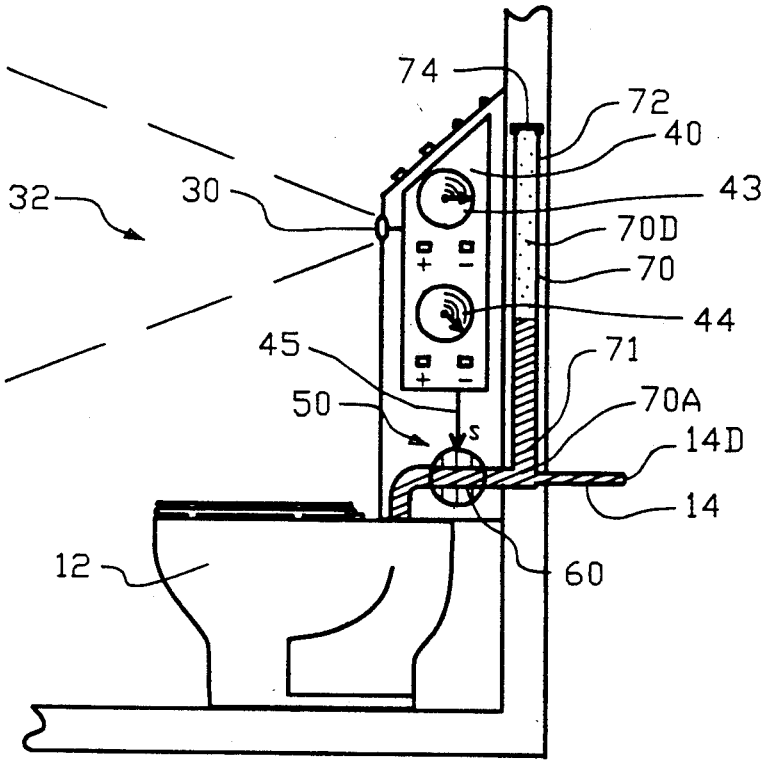
FIG. 7A is a representation of the flushing operation of the improved flushing system upon the departure of a standing person.

As shown in FIG. 7A, upon receipt of the short-flush signal from the flush timer 43, the actuator 50 moves the valve 60 into the open position for a first duration, thus allowing a first volumetric flow of water from the pressurized water line 14 into the water closet 12. The water retained in a column under high air pressure in the reservoir pipe 70 simultaneously flows into the water closet 12 thereby assisting the flow of water from the pressurized water line 14 in flushing the water closet 12. The first volumetric flow of the water from the reservoir pipe 70 and the pressurized water line 14 pass through the first conduit 65, the valve 60 and the second conduit 66 into the water closet 12 for flushing the contents therein. The first duration is established to be commensurate with an amount of time which would allow a first volumetric flow sufficient to pass through the valve 60 for flushing a liquid waste from the bowl 15 of the water closet 12 Preferably, the first volumetric flow is established to be approximately three quarts of water. When the flushing timer 43 determines that the first duration has elapsed, the actuator 50 returns the valve 60 to the closed position.

Figure 7B:
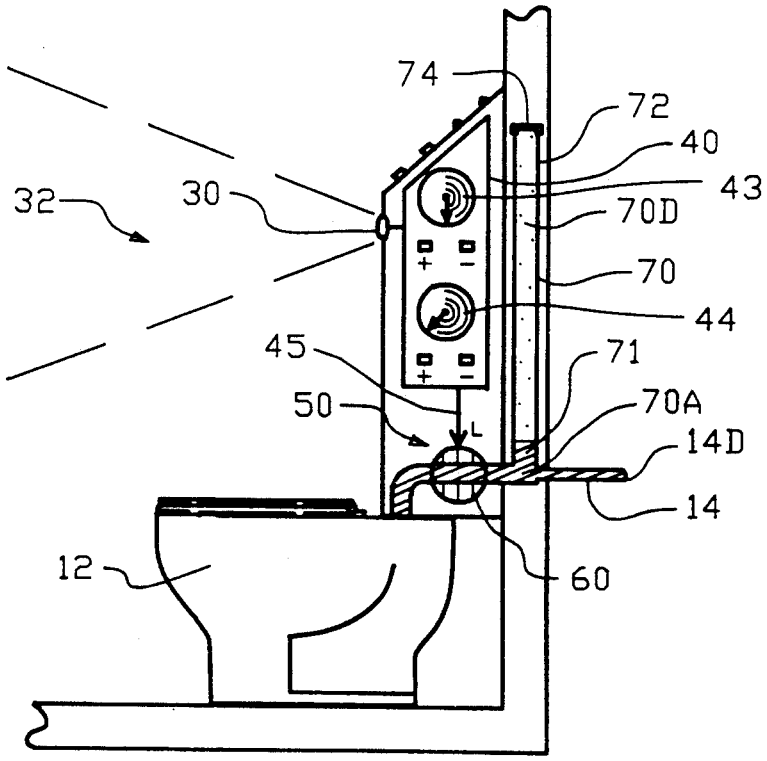
FIG. 7B is a representation of the flushing operation of the improved flushing system upon the departure of a sitting person.

As shown in FIG. 7B, upon receipt of the long-flush signal from the flush timer 43, the actuator 50 moves the valve 60 into the open position for a second duration, thus allowing a second volumetric flow of water from the pressurized water line 14 and the reservoir pipe 70 to pass through the first conduit 65, the valve 60 and the second conduit 66 into the water closet 12 thereby flushing the contents therein. Because the reservoir pipe aperture 70A of the reservoir pipe 70 is greater than the intake diameter 14D of the pressurized water line 14, the flow of water from the reservoir pipe 70 greatly enhances the flow of water from the pressurized water line 14. The second duration is established to be commensurate with an amount of time which would allow the second volumetric flow sufficient to pass through the valve 60 for flushing a solid waste. Preferably, the second volumetric flow is established to be approximately six quarts of water. When the flushing timer 43 determines that the second duration has elapsed, the actuator 50 returns the valve 60 to the closed position.

Figure 8:
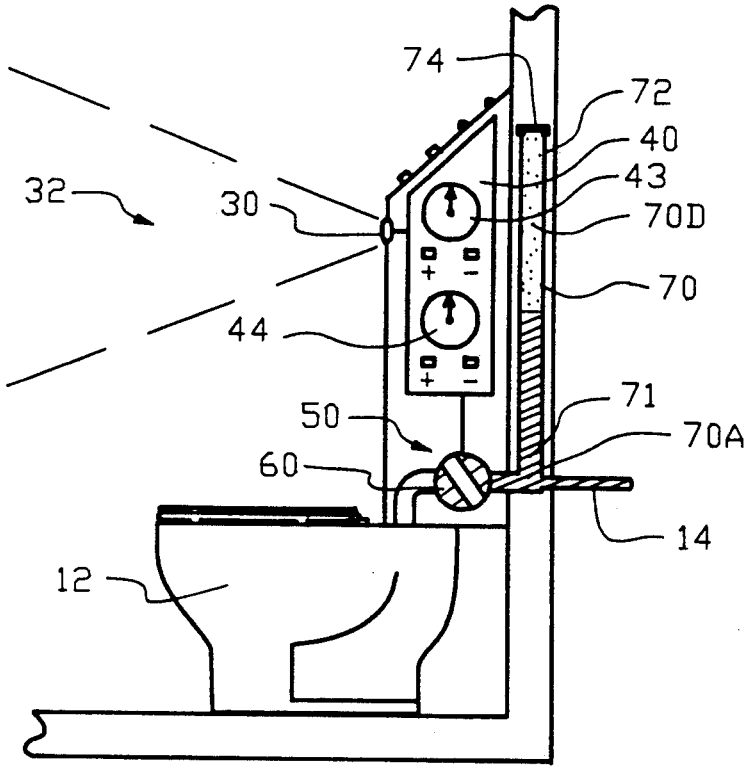
FIG. 8 is a representation of the operation of the improved flushing system following the flushing thereof.
Figure 9:
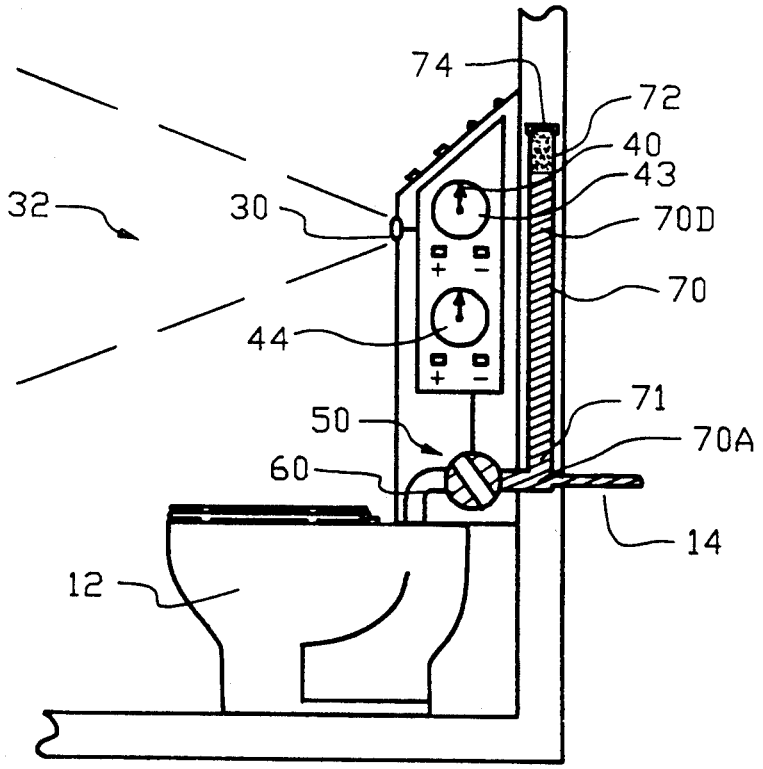
FIG. 9 is a representation of the operation of the improved flushing system upon completion of the flushing operation.

As shown in FIG. 8, after the actuator 50 returns the valve 60 to the closed position, the water flowing through the pressurized water line 14 is redirected through the reservoir aperture 70A into the reservoir pipe 70. The reservoir pipe 70 is thereby filled with water and the air contained therein above the level of the water is pressurized, until equilibrium is reached, at which time the flow of water ceases, as shown in FIG. 9.

As shown in FIG. 4, the length of time of the first duration of flush and the second duration of flush can be manually adjusted through the operation of increment button 41 and decrement button 42 and sent to set the flush timer 43. The buttons 41 and 42 are mounted internal the housing 16 and are intended to be operated by the installer of the apparatus 10 upon installation. Typically, the first and second durations of flush are not normally readjusted.

For an initial installation, the installer places a drop of food coloring into the water in the water closet 12, operates the valve 60 by depressing the number one button 21, and observes whether all the food coloring has been removed from the bowl 15. If not all the food coloring has been removed from the bowl 15, the installer presses the increment button 41. The active light emitting diode (LED) 27 will briefly illuminate indicating the signal was received and the first duration will be increased by period of time such as 0.1 seconds. If excessive water has been removed from the bowl 15, the installer presses the decrement button 42 and the first duration will be reduced by period of time such as 0.1 seconds. Preferably, the second duration is automatically set to be twice the first duration However, the second duration may be independently set by additional increment and decrement buttons (not shown).

When the apparatus 10 is in the automatic mode, the active light emitting diode (LED) 27 mounted on the top 19 of the housing 16 flashes when the arrival signal is the most recent signal accepted by the controller 40 from the sensor 30. The flashing of the active light emitting diode (LED) 27 indicates the presence of the person 55 within the zone 32. When the departure signal is the most recent signal accepted by the controller 40 from the sensor 30, the active light emitting diode (LED) 27 is not illuminated indicating the absence of the person 55 within the zone 32. When the actuator 50 moves the valve 60 to the open position, the active light emitting diode (LED) 27 remains continuously illuminated until the valve 60 closes.

In addition to the automatic mode of operation described above, the apparatus 10 may also be operated manually while in the automatic mode. When the apparatus 10 is in the automatic mode, the automatic light emitting diode (LED) 24 is illuminated and the manual light emitting diode 26 is deactivated. If the number one button 21 is pressed, the controller 40 sends a short-flush signal to the actuator 50. Upon receipt of the short-flush signal, the actuator 50 moves the valve 60 into the open position for the first duration, thus providing a first volumetric flow of water into the water closet 12. In a similar manner, if the number two button 22 is pressed, the controller 40 sends a long-flush signal to the actuator 50. Upon receipt of the long-flush signal, the actuator 50 moves the valve 60 into the open position for the second duration, thus providing a second volumetric flow of water into the water closet 12. If either the number one button 21 or the number two button 22 is depressed in either the automatic mode or the manual mode of operation, the presence timer 44 is always reset to zero and any signal emanating from the sensor 30 will be ignored for a period of approximately five seconds.

In addition to the above described automatic mode of operation, the automatic/manual button 23 may be depressed to select the manual mode of operation wherein the sensor 30 is disabled from the apparatus 10. When the automatic/manual button 23 is depressed to select the manual mode of operation, the manual light emitting diode 26 is illuminated while the automatic light emitting diode 24 is deactivated.

Figure 10:
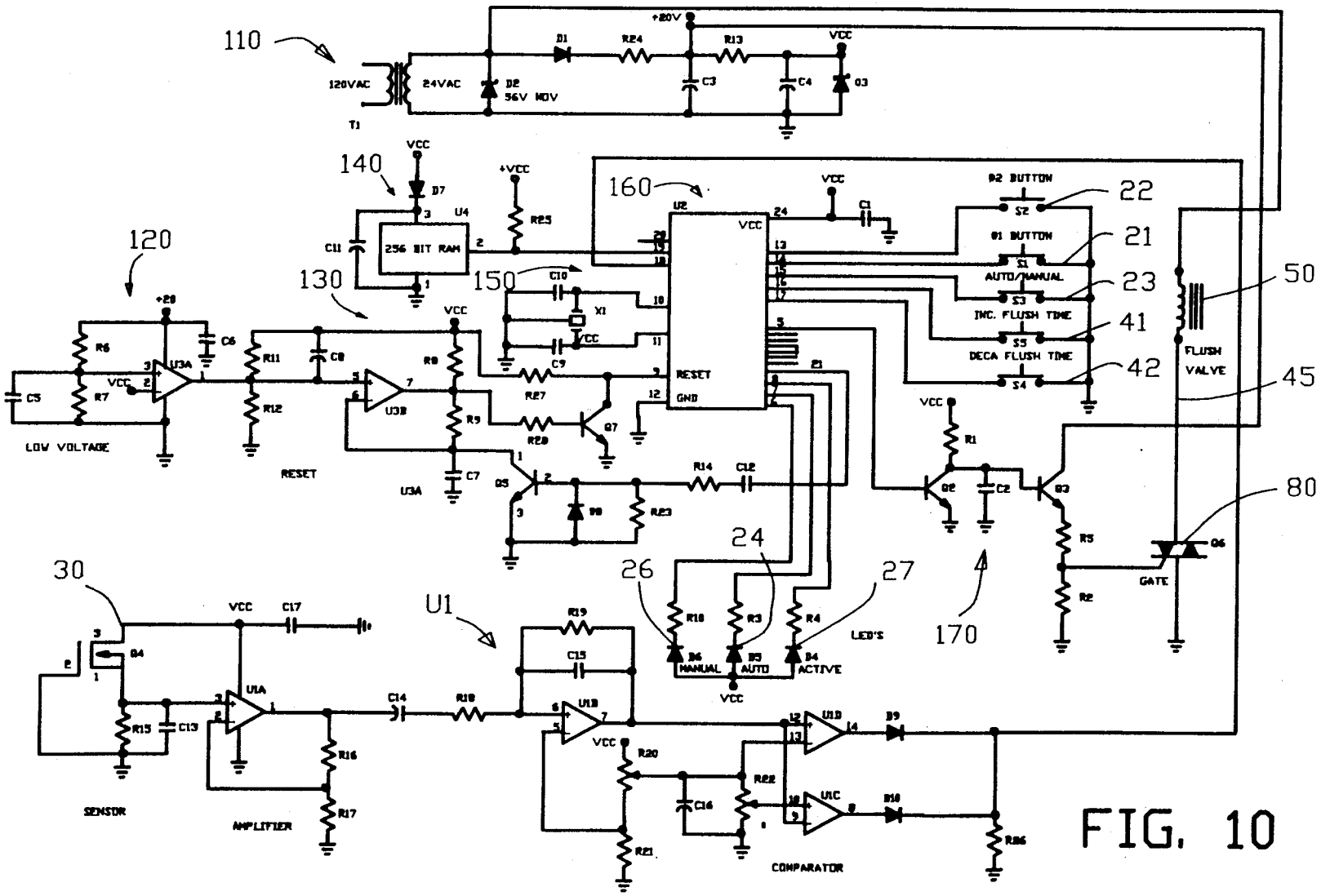
FIG. 10 is an electronic circuit diagram of the improved flushing system.

FIG. 10 is a circuit diagram of the electronic components of apparatus 10. A power source 110 comprises a transformer T1 shown as a 120-volt to 24-volt AC UL Class II wall mount transformer. The 24 volts AC of the output of transformer T1 is further reduced to 20 volts DC and 5 volts DC through diode D1, metal oxide varistor (MOV) D2, zener diode D3, resistors R13 and R24 and capacitors C3 and C4.

A low voltage detection circuit 120 comprises resistors R6 and R7, capacitors C5 and C6 and a comparator U3A having inputs 2 and 3 and an output 1. The output 1 of the comparator U3A is the input to a reset circuit 130.

A reset circuit 130 comprises resistors R8, R9, R11, R12, R14 and R23, capacitors C7, C8 and C12, diode D8 and a comparator U3B having inputs 5 and 6, and output 7. The output 7 of amplifier U3B is connected through an invertor circuit comprising R27 and R28 and Q7 to pin 9 of the microcontroller 160 shown as U2.

A memory 140 is shown as a static random access memory circuit U4 having a 256 bit static random access memory which includes a power pin 3, a ground pin 1, and a serial input output (I/O) pin 2 which is connected to pin 19 of a microcontroller 160.

Five push-buttons S1, S2, S3, S4 and S5 corresponding to the number one button 21, the number two button 22, the automatic/manual button 23, the increment button 41 and the decrement button 42, respectively, are connected to pins 14, 13, 15, 16 and 17, respectively, of microcontroller 160.

Three light emitting diodes (LED) D4, D5 and D6 corresponding to the active light emitting diode (LED) 27, the automatic light emitting diode (LED) 24 and the manual light emitting diode (LED) 26, respectively, are connected in series with resistors R4, R3 and R10, respectively, to pins 8, 7 and 6 of the microcontroller 160.

The sensor 30 comprises a pyroelectric infrared sensor Q4 is connected to the VCC, whereas the gate pin 2 of the pyroelectric infrared sensor Q4 being connected to ground. The source pin 1 of the pyroelectric infrared sensor Q4 provides an output through R15 and C13.

A four-stage AC amplifier U1 comprises a first stage AC amplifier U1A, a second stage AC amplifier U1B, a third stage AC amplifier U1C and a fourth stage AC amplifier U1D. The third stage AC amplifier U1C and the fourth stage AC amplifier U1D are each used as a comparator. The four-stage AC amplifier U1 is powered by five volts VCC, and contains resistors R16, R17, R18, R19, R21 and R26 as well as capacitors C17, C14, C15 and C16 in addition to diodes D9 and D10 and adjustable potentiometer R20 and R22.

The first-stage U1A of the AC amplifier comprises pins 3, 2 and 1, the second stage U1B of the AC amplifier comprises pins 5, 6 and 7, the third stage U1C of the AC amplifier comprises pins 8, 9 and 10 and the fourth stage U1D of the AC amplifier comprises pins 12, 13 and 14.

The output pin 1 of the pyroelectric infrared sensor Q4 is connected to pin 3 of a first stage U1A of a four-stage AC amplifier U1. The output on pin 7 of the second stage U1B is directed to the third and fourth stages U1C and U1D of the four-stage AC amplifier U1 which are connected as a comparator. The fourth stage U1D of the comparator receives the AC signal into the non-inverting pin 12 from pin 7 of the second stage U1B the four stage amplifier U1. The third stage U1C of the four stage amplifier U1 receives the same AC signal into the inverting pin 9 from pin 7 of the second stage U1B. A tap of R20 is connected to the inverting pin 13 of the fourth stage U1D, and a tap of R22 is connected to the non-inverting pin 10 of the third stage U1C. The output pulse signals from the third and fourth stages U1C and U1D are fed into pin 18 of the microcontroller 160 through diodes D9 and D10 respectively.

A resonator 150 comprises a crystal resonator X1 and capacitors C9 and C1O to provide timing for the circuit.

The microcontroller 160 is an 8-bit microcontroller such as a 8051 derivative with a mask ROM. The microcontroller 160 preferably has 2,048 bytes of instruction ROM and 64 bytes of RAM which is used for general purpose RAM and for the interrupt stack. The instructions for the microcontroller 160 are burned into the microcontroller 160. The microcontroller 160 is powered by five volts VCC at pin 24, which also leads to ground through capacitor C1, and through pin 12.

An interface 170 extends between the microcontroller 160 and the actuator 50 shown as a solenoid of the valve 60. The interface 170 comprises transistors Q2 and Q3, resistors R1, R2 and R5 and capacitor C2. The output of the interface 170 is fed to the gate of a triac 80 shown as Q6. The triac 80 is connected through line 45 to the actuator 50.

The overall function of the apparatus 10 is to automatically sense the arrival and departure of the person 55 as shown in FIGS. 5-7, measure the elapsed time, and render a short flush if the measured elapsed time is shorter than a preselected time interval and render a long flush if the measured elapsed time is longer than a preselected time interval. The apparatus may also be operated manually.

The circuit diagram of FIG. 10 operates in the following manner. The power source 110 delivers an AC source of 24 VAC to provide +20 volts DC and 5.0 volts DC (VCC). The 5.0 volts DC powers the sensor circuit 30, the four stage amplifier U1, the memory 140, and the microcontroller 160. The +20 volt DC output is for activating the gate to the triac 80, the low voltage detection circuit 120 and the reset circuit 130. The +20 volt DC output is also used as an input for the low voltage detection circuit 120. The 24 volt AC powers the actuator 50.

Upon power up, the low voltage detection circuit 120 and the reset circuit 130 releases the reset on the microcontroller 160. The function of the low voltage detection circuit 130 is to ensure that the microcontroller 160 only operates when the supply voltage conforms to the specifications of the device. As long as pin 24 of the microcontroller 160 has a VCC of 4.75 volts, the microcontroller 160 is safely running within an operating range. The low voltage detection circuit 120 receives 20 volts from the power source 110 with a voltage divider between R6 and R7 providing an input to pin 3 of U3A. If pin 3 of U3A falls below 4.75 volts, the output on pin 1 of U3A will change to a low state. If pin 1 changes to a low state, then the non-inverting pin 5 of U3B will be less than inverting pin 6 and that will cause pin 7 of U3B to change to a low state and turning off inverting transistor Q7. Accordingly, pin 9 of the microcontroller 160 will change to a high state and reset the microcontroller 160. When pin 9 of the microcontroller 160 changes to a high state, the microcontroller 160 stops and waits for the low voltage detection circuit 120 to release the reset.

The reset circuit 130 is a second method for resetting the microcontroller 160. The purpose of the reset circuit 130 is to monitor the pulses emanating from pin 21 of the microcontroller 160. Those pulses are continually turning on transistor Q7 to ground C7. An RC time constant is established by R8, R9 and C7. If pin 21 stops sending pulses, transistor Q7 will not be activated and C7 will charge. When the voltage on C7 and thereby at pin 6 of U3B exceeds the DC level at pin 5 of U3B, the output pin 7 of U3B changes to a low state which forces a reset to pin 9 of microcontroller 160. The reset forces the microcontroller 160 to restart the program from the beginning.

The memory 140 has the function of remembering the state the computer was in when the power was turned off. This state includes (1) whether the apparatus 10 is in the manual state or an automatic state, and (2) the length of the first duration of flush. These states are adjusted by depressing the buttons on the apparatus 10, as described below. Capacitor C11 acts as a battery to hold a charge for the memory 140.

The number 1 button 21 and the number 2 button 22 cause the water closet 12 to flush for the first duration and the apparatus 10 is in the automatic or manual mode. The automatic/manual button 23 switches the apparatus 10 between the automatic mode, wherein the valve 60 automatically operates, to the manual mode where only the number 1 and number 2 buttons 21 and 22 operate the valve 60. The increment and decrement buttons 41 and 42 increment and decrement the first duration of flush time as follows. Upon initial power up, the apparatus 10 has a default first duration which yields approximately a three-quart flush. The installer can increase or decrease this default first duration time by using the increment and decrement buttons 41 and 42, as described previously. Preferably, each push of the button results in a 0.1 second increment or decrement of the first duration of flush with the new value being written to the 256 Bit Ram chip of memory 140. The active light emitting diode (LED) 27, described below, illuminates each time the increment button 41 or the decrement button 42 is pushed, giving feedback to the installer. The second duration is usually twice the first duration.

The light emitting diode (LED) D6 is the manual light emitting diode (LED) 26 and light emitting diode (LED) D5 is the automatic light emitting diode (LED) 24. These two light emitting diodes (LED) are mutually exclusive, and one is always illuminated. The light emitting diode (LED) D4 is the active light emitting diode (LED) 27 and has three distinct functions.

First, when the increment button 41 or the decrement button 42 is pushed, the active light emitting diode (LED) 27 will illuminate for approximately 0.1 seconds to give the installer an indication that the press of the button was effective. Second, the active light emitting diode (LED) 27 indicates whether the microcontroller 160 a person 55 has entered the zone and the arrival of the person 55 is sensed by the sensor 30 whereat the active light emitting diode (LED) 27 will flash at a rate of about 1 flash per second. When the departure of the person 55 is sensed, the active light emitting diode (LED) 27 will not be illuminated. Third, the active light emitting diode (LED) 27 will be illuminated during the time that actuator 50 is turned activated.

The infrared sensor Q4 is powered by 5 volts VCC and provides a small AC signal when an object with a particular wavelength crosses a viewing area or the zone 32. The viewing area or zone 32 is approximately 3-5 feet vertically and horizontally without special lenses. The output pin 1 of the sensor Q4 is fed into pin 3 of U1A, the first stage U1A and the second stage U1B of the fourth-stage AC amplifier U1. The function of the first and the second stages U1A and U1B is to boost the gain from a few millivolts to a few volts. C14 blocks out any DC signal, as only an AC signal is desired. The output on pin 7 of the second stage U1B is fed into the comparator U1C and U1D.

The top stage of the comparator U1D is the noninverting stage. It receives the AC signal into pin 12 and compares the AC signal to a voltage divider applied to pin 13. If the AC signal in pin 12 exceeds the DC signal in pin 13, the output pin 14 of the comparator U1D changes from a low state to a high state or from zero volts to five volts.

The bottom stage of the comparator U1C is the inverting stage. The bottom stage of the comparator U1C receives the AC signal into pin 9 and compares the signal to a voltage divider which is applied to pin 10. If the AC signal in pin 9 falls below the DC signal in pin 10, the output of the comparator U1C, pin 8, will change from a low state to a high state, or from zero volts to five volts.

The top stage of comparator U1D is comparing only the positive portion of the sinusoidal AC signal whereas the bottom stage of the comparator U1C is comparing only the negative portion. Each stage activates only when the AC signal exceeds a threshold defined by the DC signal being applied to the comparator input.

R20 is connected to pin 13 of comparator U1D and defines the threshold above which the positive side of the sign wave will activate the comparator U1D. R22 is connected to pin 10 of comparator U1C and defines the threshold above which the negative side of the sign wave will activate the comparator U1C.

The result of these two stages of the comparator U1C and U1D is that each time the AC signal from the sensor goes above pin 13 of comparator U1D or below pin 10 of comparator U1C, the outputs of the comparators U1C and U1D will change to a high state. Typically, the output of comparator U1D will change to a high state for a moment, then the output of comparator U1C will change to a high state. The two output pulses alternate when a person walks into or departs the zone 32. The pulse duration of each of the output pulses is always less than one-half second. The output pulse signals from the comparator U1C and U1D are applied into pin 1 of the microcontroller 160. The microcontroller 160 controls the overall operation of the apparatus 10.

The function of the resonator 150 is to establish the time base of the microcontroller 160 clock oscillator. The controller 40, represents all the components on the circuit board herein described, except the sensor 30, the actuator 50 and the transformer T1.

The interface 170 between the microcontroller 160 and the triac 80 comprises transistors Q2 and Q3, which are buffers to insure that the proper signal arrives at the gate of the triac 80. The triac 80 is a switch for energizing the actuator 50 with 24 volts AC. Transistors Q2 and Q3 are not essential for the operation of the controller 40 since the microcontroller 160 may be directly connected to the triac 80 without any interface 170.

Figure 11A:
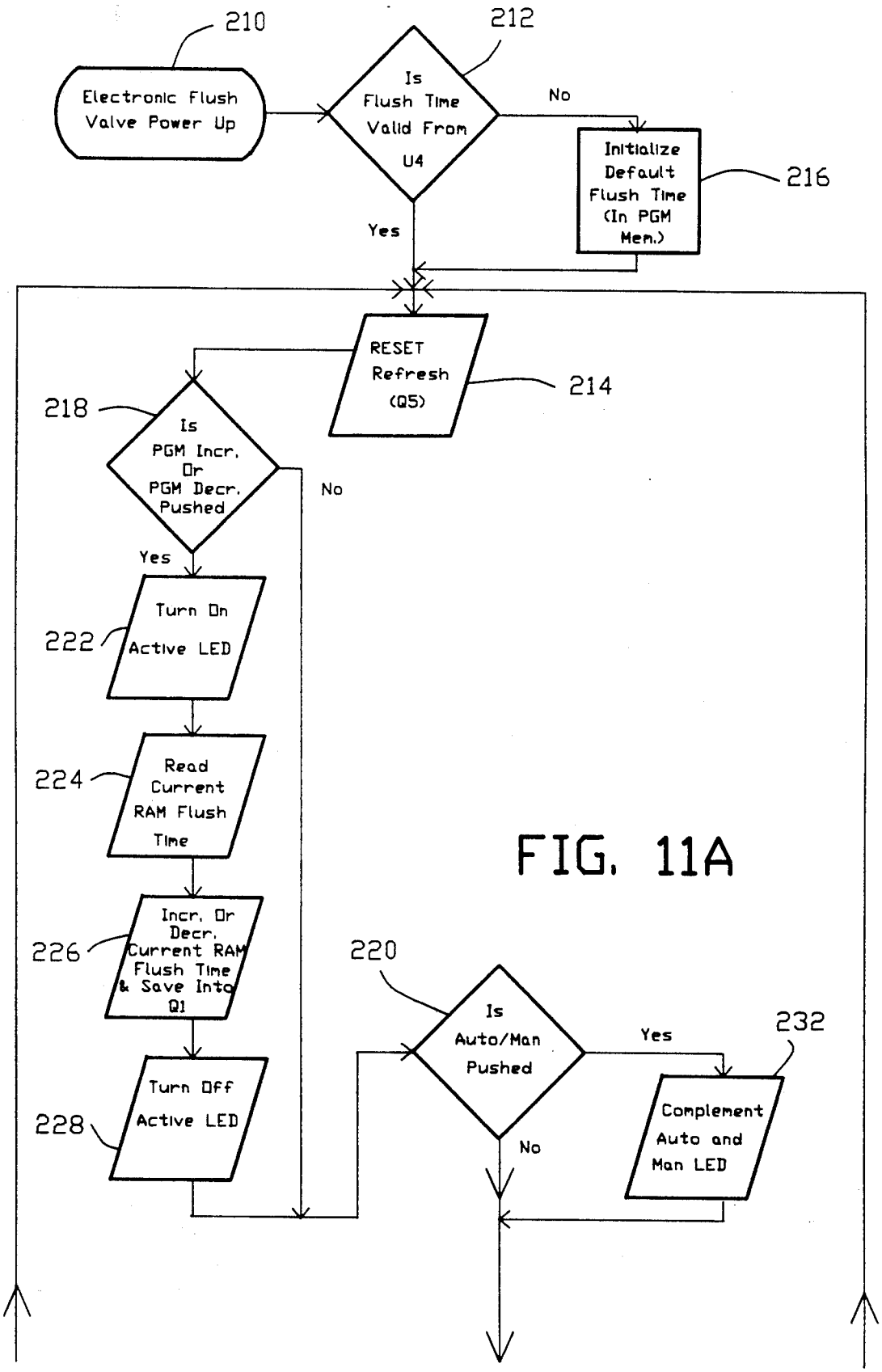
FIG. 11A is a first portion of a logic diagram representing the operation of the improved flushing system.

FIG. 11A shows the first portion of the logic diagram representing the operation of the circuit. Logic block 210 labeled "Electronic Flush Valve Power Up" indicates that the first step in the logic diagram is the turning on the power. The low voltage detection circuit 120 checks for the appropriate voltage upon application of power.

Logic block 212 labeled "Is flush time valid from U4?" indicates the controller reads the first duration, or flush time from U4 or memory 140. If the reading is valid, the controller reads the flush duration into the microcontroller 160 and the sequence proceeds to logic block 214 labeled "reset circuit refresh." A reading from U4 or memory 140 that is not valid would normally indicate that this is the very first time the apparatus 10 has been powered up. The logic would then go to Logic block 216 labeled "Initialize default flush time" and default to the default flush time located is in the memory within microcontroller 160. The default flush time is that amount of time which would yield an approximately three-quart flush.

The logic block 214 labeled "reset circuit refresh" is the first step at the top of the main logical loop. Logic block 214 indicates that each time the logic goes through the loop, the capacitor C7 within the reset circuit 130 will be discharged, thereby preventing reset. The microcontroller 160 refreshes the reset circuit 130 by sending a pulse to activate transistor Q5 to discharge C7. If the microcontroller 160 fails to issue the pulses, C7 will charge up and the microcontroller 160 will be reset.

The logic block 218 labeled "Is program increment or decrement button pushed?" determines the first duration of flush time. This is normally performed by the installer when the apparatus 10 is installed, as previously described. If the answer is no, the logic proceeds to Logic block 220 "Is the automatic/manual pushed?" to be described hereinafter. If the answer to logic block 218 is yes, the logic proceeds to Logic block 222 labeled "Turn on Active LED." indicating that a button has just been pushed. The microcontroller 160 turns on the active light emitting diode (LED) 27, proceeds to logic block 224 and reads the current first duration flush time from U4 or memory 140. The microcontroller 160 the proceeds to logic block 226 and increments or decrements the current first duration flush time by approximately 0.1 seconds each time the respective button is pushed. The microcontroller 160 then saves the new first duration flush time in the memory of the microcontroller 160, and writes the flush duration to the memory 140 to be saved permanently. The microcontroller 160 the proceeds to logic block 228 and deactivated the active light emitting diode (LED) 27.

Logic block 220 labeled "Is the automatic/manual pushed?" checks whether the automatic/manual button 23 has just been pushed. If no, the logic proceeds to logic block 230 labeled "Automatic or Manual" shown in FIG. 11B. If the answer to logic block 220 is yes, the logic proceeds to logic block 232 labeled "Complement Auto and Man LED" whereat the apparatus 10 is toggled to the opposite state or switched from the manual mode to the automatic mode or from the automatic mode to the manual mode. Simultaneously, the state of the automatic light emitting diode (LED) 24 and manual light emitting diode (LED) 26 are complemented or switched to indicate if either the automatic mode or the manual mode is the active mode.

Figure 11B:
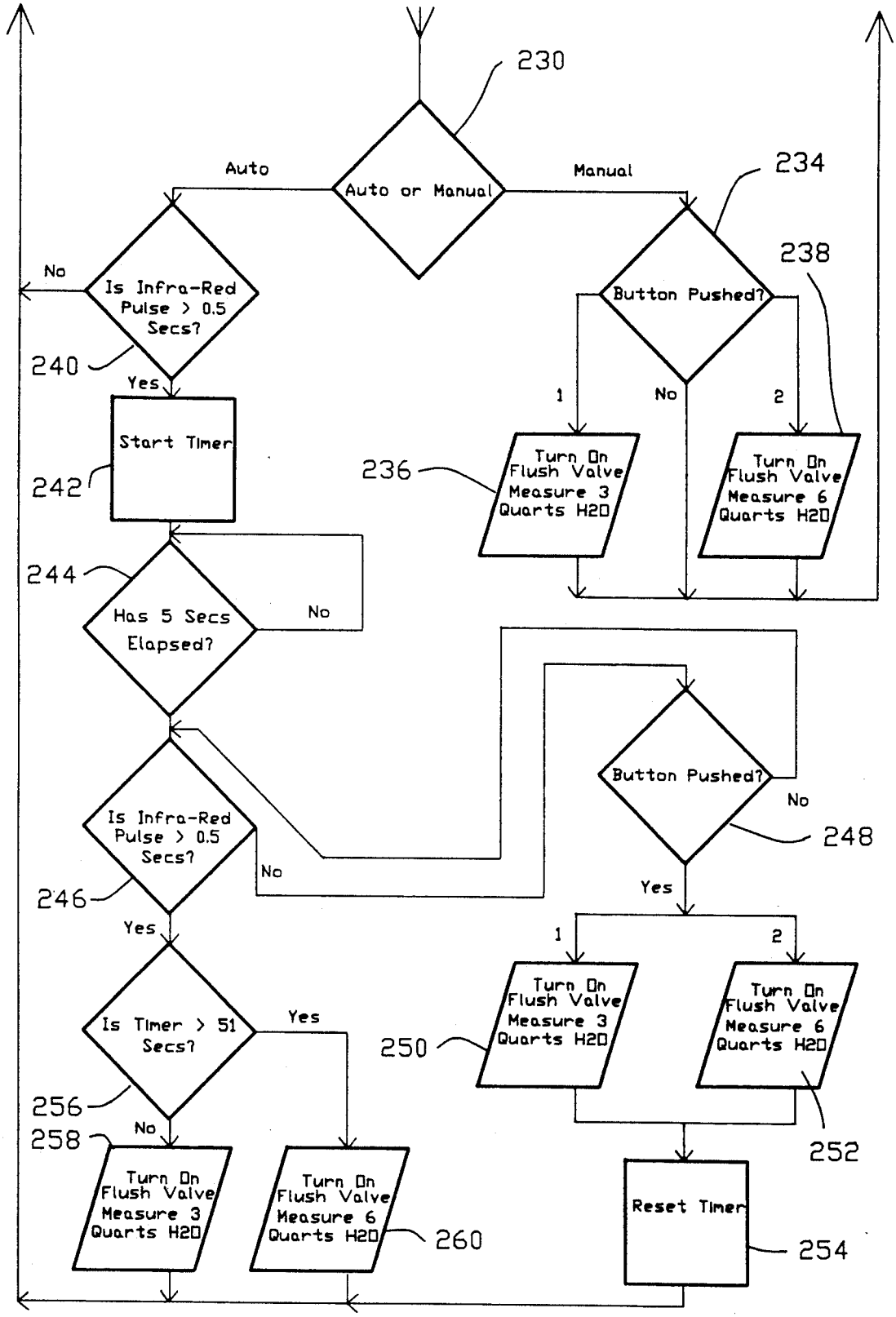
FIG. 11B is a second portion of the logic diagram of FIG. 11A.

FIG. 11B shows the second portion of the logic diagram shown in FIG. 11A. Logic block 230 labeled "Automatic or Manual" determines whether the apparatus 10 will operate in the automatic mode or the manual mode. If the apparatus 10 is to be operated in the manual mode the logic proceeds to logic block 234 labeled "Button Pushed". If no button has been pushed, the logic returns to the logic block 214 labeled "reset refresh" in FIG. 11A. If the number 1 button 21 is pushed, the logic proceeds to logic block 236 labeled "Turn on Flush Valve, Measure 3 Quarts" to flush a liquid waste from the bowl 15. If the number 2 button 22 is pushed, the logic proceeds to logic block 238 labeled "Turn on Flush Valve, Measure 6 Quarts" to flush a solid waste from the bowl 15. Following either flush of logic blocks 236 or 238, the logic returns to the logic block 214 labeled "reset refresh" in FIG. 11A.

If the apparatus 10 is to be operated in the automatic mode the logic proceeds to logic block 240 on FIG. 11B labeled "Is Infra-Red Pulse >0.5 Sec." If the apparatus 10 is in the automatic mode, it must then be determined whether a pulse of a duration greater than one-half second has been received from the infrared sensor 30. If no pulse or a pulse less than 0.5 seconds has been received, the logic returns to the logic block 214 labeled "reset circuit refresh" in FIG. 11A. If a one-half second pulse or greater duration pulse has been received, the logic proceeds to logic block 242 labeled "Start Timer" which starts the presence timer 44. The logic then proceeds to logic block 244 labeled "Has 5.0 seconds elapsed?". When the 5.0 seconds has elapsed, the logic looks for the next valid one-half second or greater pulse from the infrared sensor 30. If such a pulse has not been received, it is assumed that the water closet 12 is still in use and the logic proceeds to logic block 248 labeled "Button Pushed."

If number 1 button 21 has been pushed, the valve 60 opens for the first duration as illustrated in logic block 250 allowing approximately a three-quart flush. If the number 2 button 22 has been pushed, the valve 60 opens for the second duration as illustrated in logic block 246 allowing approximately a six-quart flush. The presence timer 44 would also be reset to zero if either number 1 button 21 or number 2 button 22 is pushed. If neither button is pushed, the logic stops here until a pulse greater than one-half second is received. When the pulse is received, the elapsed time is read from the presence timer 44, and compared to the value of approximately 51 seconds. If the elapsed time is less than 51 seconds, it is assumed that a liquid waste must be removed and the valve 60 is opened for a first duration to produce the three-quart flush. If the elapsed time is greater than 51 seconds, it is assumed that a solid waste must be removed and the valve 60 is opened for a second duration to produce the six-quart flush. In either event, the logic proceeds back to the logic block 214 in FIG. 11A.

The following is a further explanation of the one-half second limit on the pulse length, and the kill-five-seconds logic. In order to filter out nuisance signals, the controller ignores pulses of less that one-half second. When the person 55 actually enters the zone 32 to use the water closet 12, the pulses will always continue for more than one-half second. Nuisance signals may occur if the person 55 or and animal briefly passes by the zone 32. Also, while the person 55 is using the water closet 12, there may movements such as moving ones arms, which would cause a brief pulse. Since these movements do not indicate a departure, these brief pulses should be ignored. As such, pulses of less than one-half second received by the controller 40 are ignored.

Furthermore, when the person 55 arrives at the water closet 12, there will be a initial period during which the person 55 is preparing and positioning himself to use the water closet 12. This activity may result in pulses of greater than one-half second. As such, after arrival the initial kill-five-seconds period is incorporated into the logic during which the controller 40 ignores all pulses, regardless of length. The logic assumes that after five seconds the person 55 is settled, and any further activity resulting in pulses of greater than one-half second indicates a departure.

In summary, the apparatus 10 described above is an improved flushing system which both minimizes water usage on each flush of the water closet 12 thereby conserving water, and does so automatically such that no user intervention is required. The apparatus 10 further detects and distinguishes between when a liquid waste is to be removed and when a solid waste is to be removed, and removes the waste automatically with a minimal amount of water.

Figure 12:
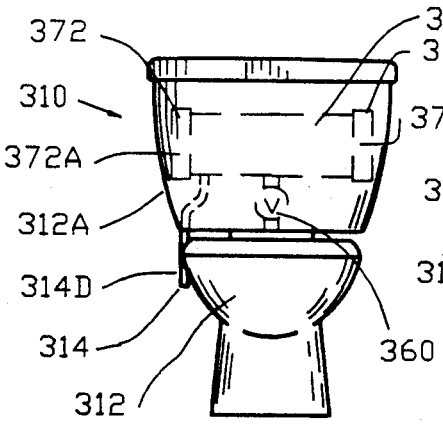
FIG. 12 is a front view of a second embodiment of an improved flushing system mounted on a water closet.
Figure 13:
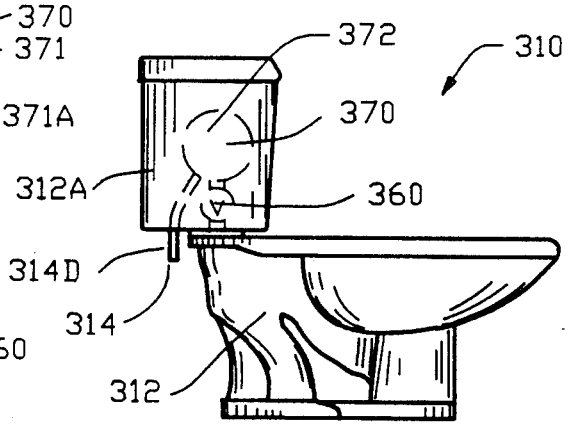
FIG. 13 is a side view of FIG. 12.
Figure 14:
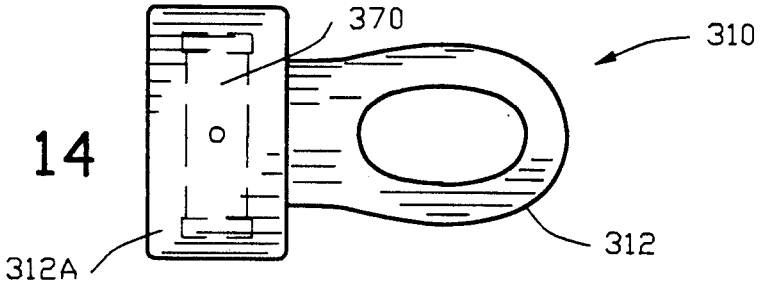
FIG. 14 is a top view of FIG. 13.

FIGS. 12–14 are side, front and top views of second embodiment of an improved apparatus, shown generally as 310, for flushing a water closet 312 with a flow of pressurized water. The improved apparatus 310 includes a controller (not shown) such as the controller 40 illustrated in FIGS. 1–10.

Figure 15:
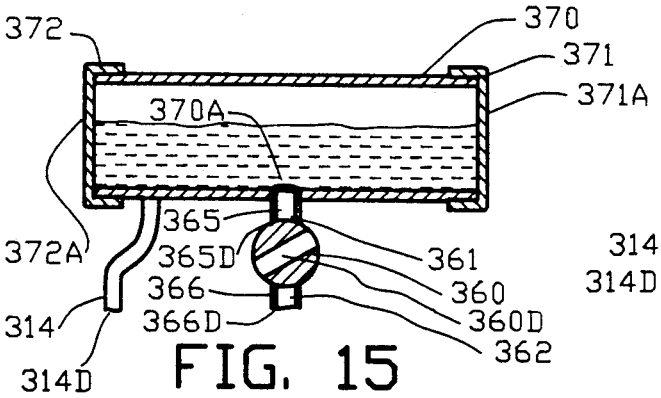
FIG. 15 is an enlarged sectional view of a portion of the improved flushing system of FIG. 12 being completely filled by the pressurized water line.
Figure 16:
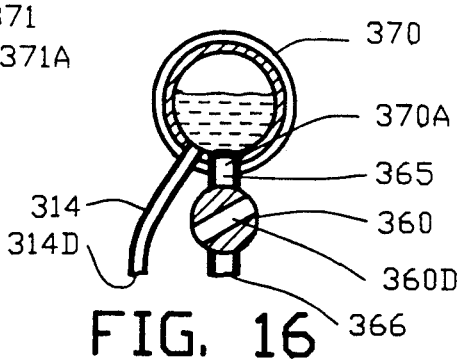
FIG. 16 is a side view of FIG. 15.

FIG. 15 is an enlarged sectional view of a portion of the improved flushing system of FIG. 12 with FIG. 16 being a sectional view of FIG. 15. A valve 360 has a valve input 361 and a valve output 362 and a valve diameter 360D. The valve 360 is shown in a closed position in FIGS. 15 and 16 and is shown in an open position in FIGS. 17 and 18.

A first conduit 365 having a first conduit diameter 365D connects the valve input 361 of the valve 360 to a reservoir 370. A second conduit 366 having a second conduit diameter 366D connects the valve output 362 of the valve 360 to the water closet 312.

A pressurized water line 314 is connected to the reservoir 370 for filling the reservoir 370 with pressurized water. FIGS. 15 and 16 illustrate a reservoir 370 being completely filled by the pressurized water line 314. The air remaining within the reservoir 370 is pressurized by the water entering the reservoir 370 from the pressurized water line 314.

The reservoir 370 is mounted horizontally within the water tank 312A of the water closet 312. The reservoir 370 is adapted to be fitted within a conventional water tank 312A of the water closet 312 without modification of the water closet tank 312A. The reservoir 370 has a first end 371 and a second end 372 closed by caps 371A and 372A. A reservoir diameter 370D defines a reservoir aperture 370A at the connection of the first conduit 365. The reservoir 370 may be constructed of plastic tubing and caps similar to the plastic tubing and end caps used in plumbing drains as should be well known to those skilled in the art.

The valve diameter 360D, the first conduit diameter 365D and the second conduit diameter 366D are equal to the reservoir aperture 370A and are substantially greater than the intake diameter 314D of the pressurized water line 314.

Preferably, the cross-sectional area of each of the valve diameter 360D, the first conduit diameter 365D and the second conduit diameter 366D is equal to the cross-sectional area of the reservoir aperture 370A.

Figure 17:
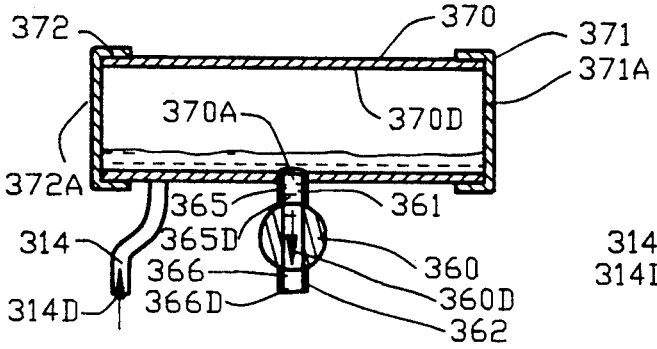
FIG. 17 is an enlarged sectional view of a portion of the improved flushing system of FIG. 12 being completely discharged into the water closet.
Figure 18:
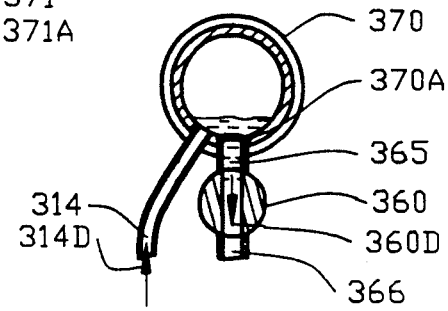
FIG. 18 is a side view of FIG. 17.

FIGS. 17 and 18 illustrate the valve 360 in an open position and the water from the reservoir 370 being discharged into the water closet 312. Upon receipt of the short-flush signal from the flush timer, the valve 360 is moved into the open position for a first duration, thus allowing a first volume of water to flow from the reservoir 370 through the first conduit 365, the valve 360 and the second conduit 366 into the water closet 312. The high air pressure within the reservoir 370 is responsible for virtually the entire flow of water from the reservoir 370 into the water closet 312. The first duration is established to be sufficient for flushing a liquid waste from the water closet 312. Preferably, the first volume of water is established to be approximately three quarts of water. When the flushing timer determines that the first duration has elapsed, the valve 360 is returned into the closed position.

Upon receipt of the long-flush signal from the flush timer, the valve 360 is moved into the open position for a second duration, thus allowing a second volume of water to flow from the reservoir 370 through the first conduit 365, the valve 360 and the second conduit 366 into the water closet 12. Preferably, the reservoir 370 has a volume of at least six quarts for providing all of the water required for providing either a first volume of three quarts of water for flushing a liquid waste or for providing a second volume of six quarts of water for flushing a solid waste.

Figure 19:
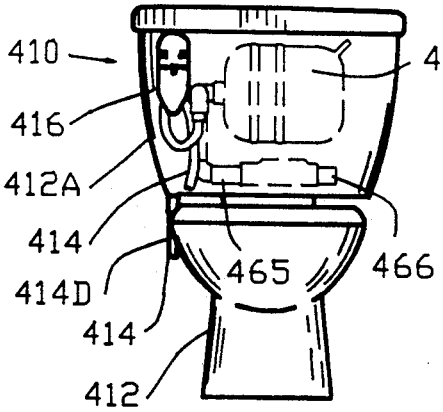
FIG. 19 is a front view of a third embodiment of an improved flushing system mounted on a water closet.
Figure 20:
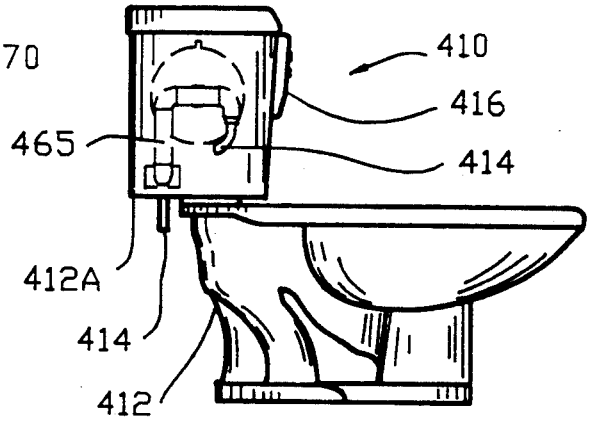
FIG. 20 is a side view of FIG. 19.
Figure 21:
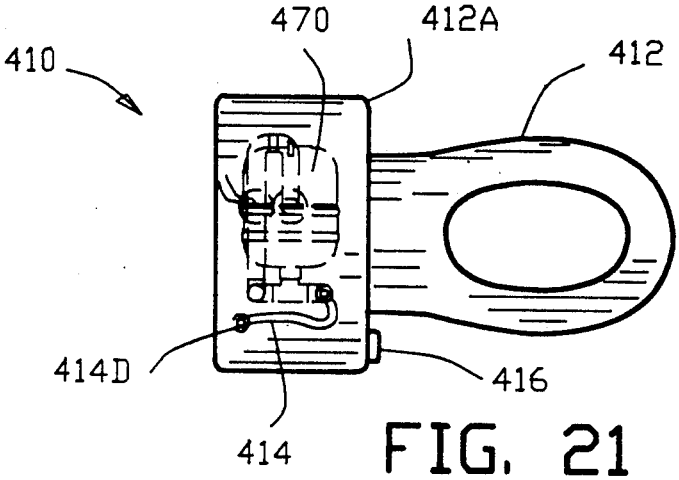
FIG. 21 is a top view of FIG. 20.

FIGS. 19–21 are side, front and top views of a third embodiment of an improved apparatus, shown generally as 410, for flushing a water closet 412 with a flow of water from a pressurized water line.

Figure 22:
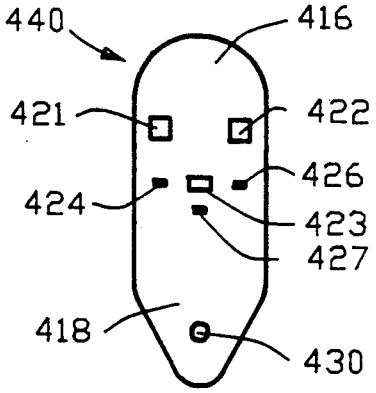
FIG. 22 is an enlarged front view of a controller of the third embodiment of the improved flushing system.
Figure 23:
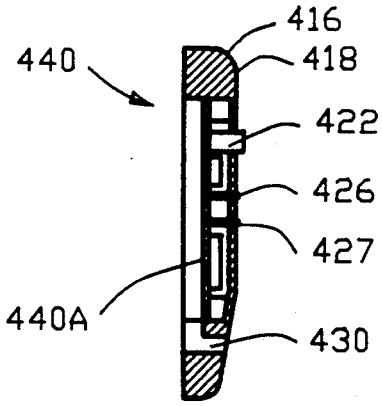
FIG. 23 is a sectional view of FIG. 22.

FIG. 22 is an enlarged front view of a controller 440 of the third embodiment of the improved flushing system 410. FIG. 23 is sectional view of FIG. 22 illustrating the mounting of a circuit board 440A containing virtually all of the components of the controller 440 within the housing 416. The controller 440 may be identical to the controller 40 as heretofore described. The controller 440 includes a number one button 421, a number two button 422, an automatic/manual button 423 as well as an automatic light emitting diode (LED) 424, a manual light emitting diode (LED) 426 and an active light emitting diode (LED) 427. A sensor 430 is shown protruding through the front 418 of the housing 416 of the apparatus 10.

Preferably, the housing 416 is secured to the water tank 412A of the water closet 412 by suitable mechanical means. The housing 416 may be secured to a conventional water tank 412A of the water closet 412 with the electrical line 45 of FIGS. 1–10 extending through the conventional flush handle aperture as should be well know to those skilled in the art.

FIGS. 24–35 are sectional view of a portion of the third embodiment of an improved flushing system 410. The improved flushing system 410 comprising a valve 460 having a valve input 461 and a valve output 462 and a valve diameter 460D. A first conduit 465 having a first conduit diameter 465D connects the valve input 461 of the valve 460 to a reservoir 470. A second conduit 466 having a second conduit diameter 466D connects the valve output 462 of the valve 460 to the water closet 412.

The reservoir 470 is mounted within the water tank 412A of the water closet 412. The reservoir 470 is adapted to be fitted within a conventional water tank 412A of the water closet 412 without modification of the water closet tank 412A. The reservoir 470 has an internal diaphragm 470D made of a resilient material such as rubber or the like. The internal diaphragm 470D separates the internal volume of the reservoir 470 into a first chamber 471 and a second chamber 472. A reservoir aperture 470A is connects the first chamber 471 to the first conduit 465. A pressurized water line 414 is connected to the first chamber 471 of the reservoir 470 for filling the first chamber of the reservoir 470 with pressurized water. The second chamber 472 of the reservoir 470 includes an air valve 475 for admitting compressed air into the second chamber 472.

The valve diameter 460D, the first conduit diameter 465D and the second conduit diameter 466D are equal to the reservoir aperture 470A and are substantially greater than the intake diameter 414D of the pressurized water line 414. Preferably, the cross-sectional area of each of the valve diameter 460D, the first conduit diameter 465D and the second conduit diameter 466D is equal to the cross-sectional area of the reservoir aperture 470A.

Figure 24:
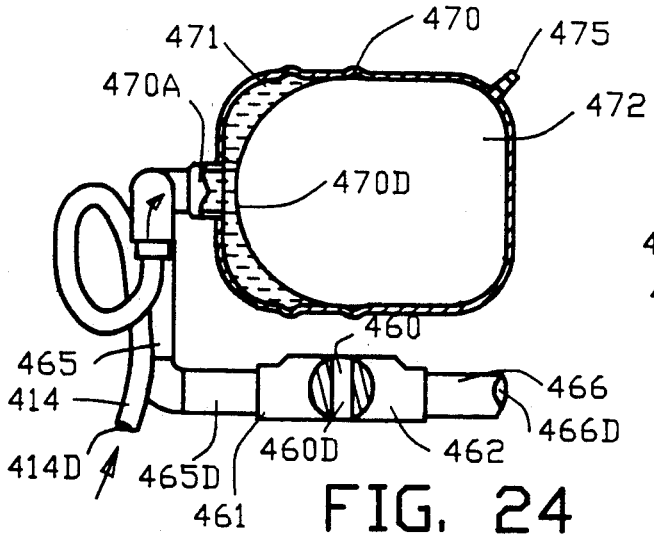
FIG. 24 is a longitudinal sectional view of a substantially empty water reservoir disposed within the third embodiment of an improved flushing system shown in FIG. 19.
Figure 25:
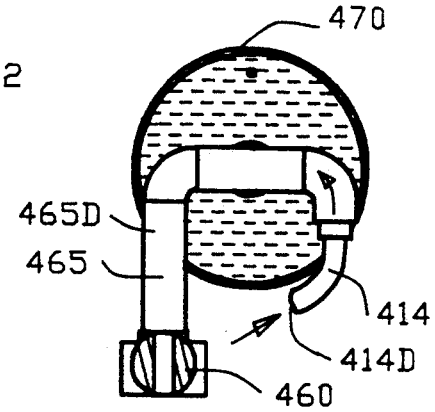
FIG. 25 is a transverse sectional view of FIG. 24.

FIGS. 24 and 25 illustrate the first chamber 471 of the reservoir 470 being substantially empty of water. Water from the pressurized water line 414 flows into the first chamber 471 of the reservoir 470 thereby deforming the internal diaphragm 470D and compressing the air within the second chamber 472 of the reservoir 470.

Figure 26:
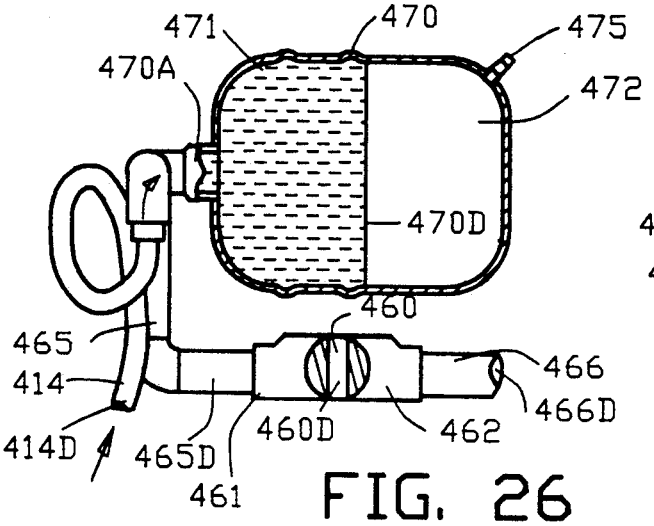
FIG. 26 is a longitudinal sectional view of the water reservoir being partially filled by a pressurized water line.
Figure 27:
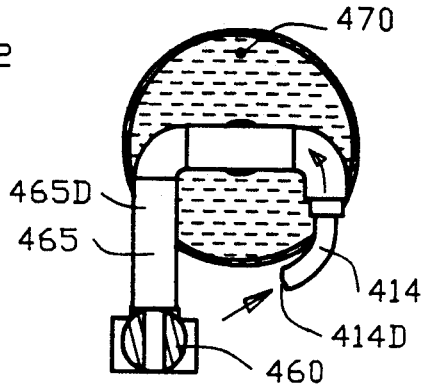
FIG. 27 is a transverse sectional view of FIG. 26.

FIGS. 26 and 27 illustrate the first chamber 471 of the reservoir 470 being partially filled with water by a pressurized water line 414. The internal diaphragm 470D is further deformed and the air within the second chamber 472 of the reservoir 470 is further compressed by the water by a pressurized water line 414.

Figure 28:
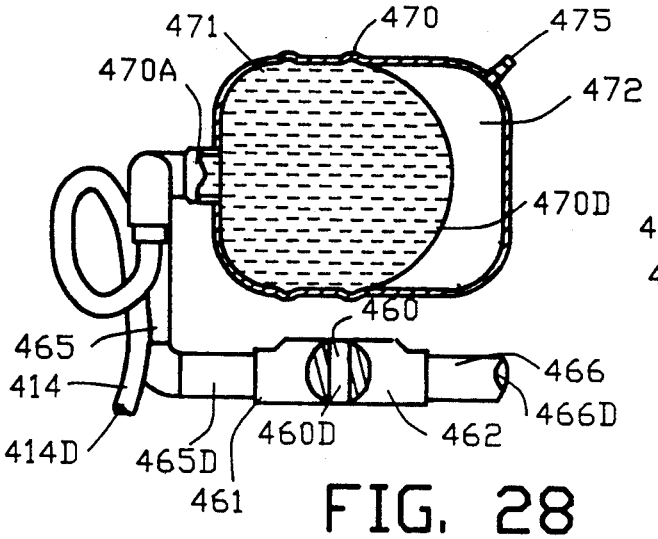
FIG. 28 is a longitudinal sectional view of the water reservoir after being completely filled by the pressurized water line and with a flush valve being closed.
Figure 29:
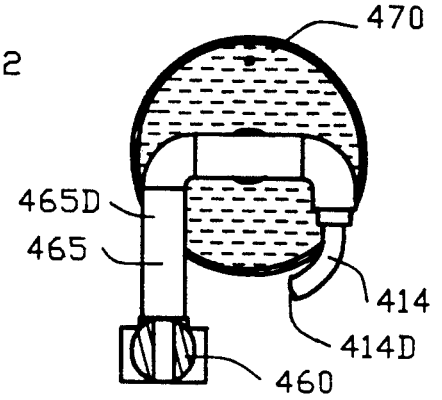
FIG. 29 is a transverse sectional view of FIG. 28.

FIGS. 28 and 29 illustrate the first chamber 471 of the reservoir 470 being totally filled with water by a pressurized water line 414. The internal diaphragm 470D is completely deformed and the air within the second chamber 472 of the reservoir 470 is further compressed by the water by a pressurized water line 414. The volume of the water within the first chamber 471 of the reservoir 470 may be adjusted by adjusting the initial air pressure within the second chamber 472 of the reservoir 470 relative to the water pressure of the pressurized water line 414. The initial air pressure within the second chamber 472 of the reservoir 470 may be adjusted by substantially emptying the first chamber 471 of the reservoir 470 as shown in FIG. 24 and increasing or decreasing the air pressure of the second chamber 472 through the air valve 475. The air pressure within the second chamber 472 may be increased or decreased through the use of a low volume pump or the like connected to the air valve 475.

Figure 30:
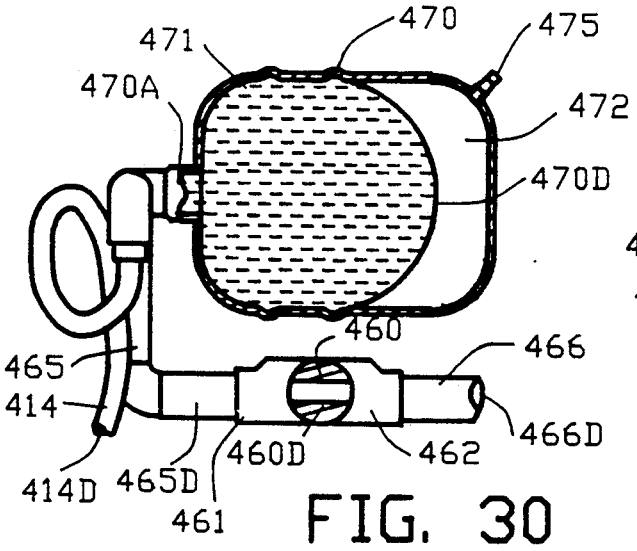
FIG. 30 is a longitudinal sectional view of the water reservoir being completely filled and with a flush valve being initially opened.
Figure 31:
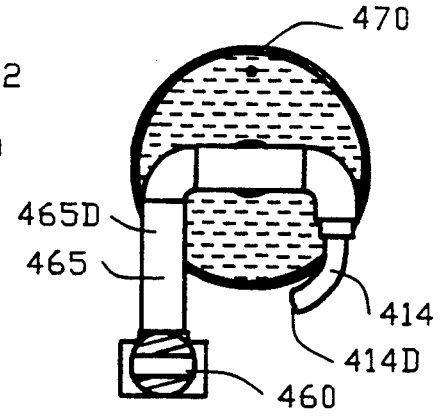
FIG. 31 is a transverse sectional view of FIG. 32.

FIGS. 30 and 31 illustrates the first chamber 471 of the water reservoir 470 being completely filled with water and with the flush valve 460 after being initially opened.

Figure 32:
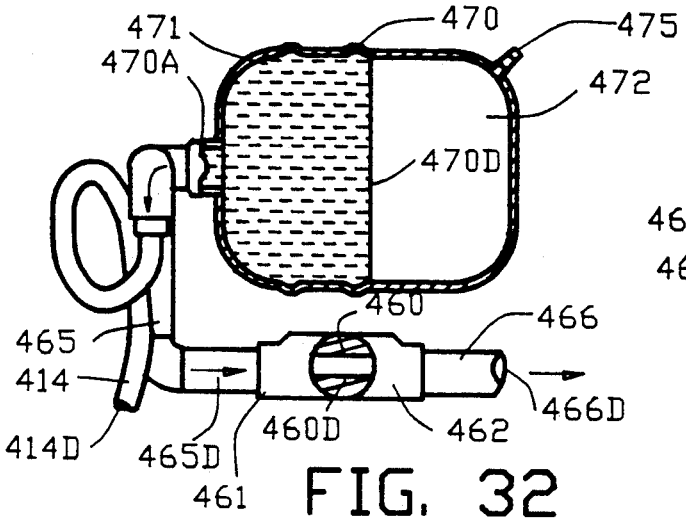
FIG. 32 is a longitudinal sectional view of the water reservoir while being partially discharged through the flush valve.
Figure 33:
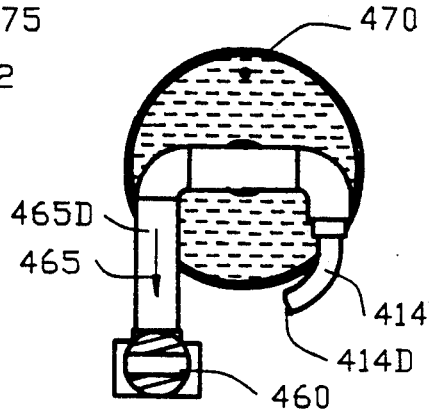
FIG. 33 is a transverse sectional view of FIG. 32.

FIGS. 32 and 33 illustrate the water within the first chamber 471 of the reservoir 470 being partially discharged into the water closet 412. The partial discharge of the water within the first chamber 471 of the reservoir 470 is demonstrative of a short-flush for flushing a liquid waste. Upon receipt of the short-flush signal from the flush timer, the valve 460 is moved into the open position for a first duration, thus allowing a first volumetric flow of water from the first chamber 471 of the reservoir 470 to flow into the water closet 412. The high air pressure in the second chamber 472 of the reservoir 470 propels the water with in the first chamber 471 of the reservoir 470 under high air pressure into the water closet 412 for flushing the water closet 412. The first volumetric flow of the water flows from the first chamber 471 of the reservoir 470 through the first conduit 465, the valve 460 and the second conduit 466 into the water closet 412 for flushing a liquid waste. Preferably, the first volumetric flow is established to be approximately three quarts of water. When the flushing timer determines that the first duration has elapsed, the valve 460 is returned into the closed position.

Figure 34:
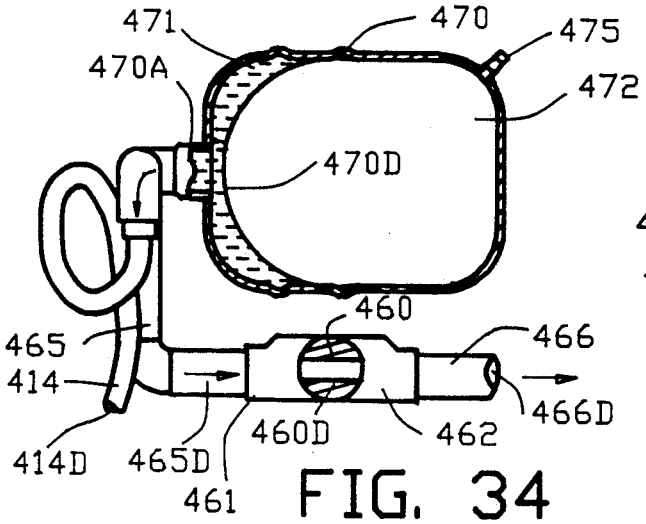
FIG. 34 is a longitudinal sectional view of the water reservoir while being fully discharged through the flush valve.
Figure 35:
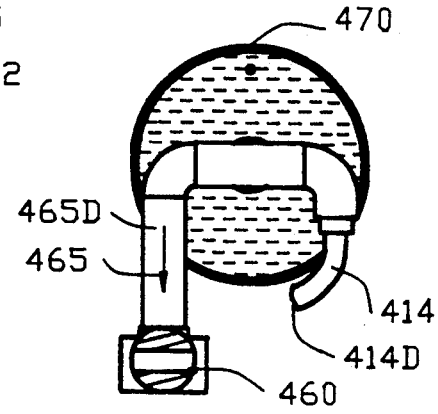
FIG. 35 is a transverse sectional view of FIG. 34.

FIGS. 34 and 35 illustrate the water within the first chamber 471 of the reservoir 470 being fully discharged into the water closet 412. The full discharge of the water within the first chamber 471 of the reservoir 470 is demonstrative of a long-flush for flushing a liquid waste. Upon receipt of the long-flush signal from the flush timer, the valve 460 is moved into the open position for a second duration, thus allowing a second volumetric flow of water from the first chamber 471 of the reservoir 470 to flow into the water closet 412. The high air pressure in the second chamber 472 of the reservoir 470 propels the water with in the first chamber 471 of the reservoir 470 under high air pressure into the water closet 412 for flushing the water closet 412. Preferably, the second volumetric flow is established to be approximately six quarts of water for flushing a solid waste.

The apparatus 10 can operate automatically thus providing greater convenience to the user, and increased sanitation due to the assurance that the water closet 12 will be flushed after each use. The apparatus 10 enhances the flow of water from the water system into the water closet 12 in those locations where low water pressure conditions exist. The enhanced water flow is more effective in cleaning solid material in the water closet 12 and results in a more sanitary and aesthetically pleasing condition. The further advantage of reducing pipe vibration due to sudden stopping of flow of water upon closing of valve is obtained.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

WHAT IS CLAIMED IS:

1. An improved flushing system for flushing a water closet with a flow of water from a pressurized water line after use by a person, comprising:

a sensor mounted relative to the water closet for sensing an arrival of the person within a zone and a departure of the person from said zone, said zone being located in a preselected proximity relative to the water closet;

a controller connected to said sensor for determining the existence of a short-flush condition and the existence of a long-flush condition;

said short-flush condition existing when said departure is sensed by said sensor, and an elapsed time between said arrival and said departure is less than a preselected time interval;

said long-flush condition existing when said departure is sensed by said sensor, and said elapsed time is greater than said preselected time interval;

a valve interposed between the pressurized water line and the water closet;

said valve having an open position for enabling the flow of water into the water closet and having a closed position for inhibiting the flow of water into the water closet;

an actuator connected to said valve and said controller for moving said valve into said open position for a first duration when said controller determines the existence of said short-flush condition, and for then returning said valve into said closed position; and said actuator for moving said valve into said open position for a second duration when said controller determines the existence of said long-flush condition, and for then returning said valve to said closed position.

2. An improved flushing system as set forth in claim 1, wherein said zone includes an area which is occupied by the person when seated upon the water closet or when standing immediately adjacent the water closet.

3. An improved flushing system as set forth in claim 1, wherein said sensor comprises an infrared sensor for sensing said arrival of the person within said zone and said departure of the person from said zone.

4. An improved flushing system as set forth in claim 1, wherein said sensor provides an arrival signal to said controller when said sensor senses the person arriving within said zone; and said sensor provides a departure signal to said controller when said sensor senses the person departing from said zone.

5. An improved flushing system as set forth in claim 1, wherein said controller determines said arrival of the person within said zone, determines said departure of the person from said zone, measures said elapsed time between said arrival and said departure, and compares said elapsed time to said preselected time interval, thereby determining the existence of said short-flush condition and said long-flush condition.

6. An improved flushing system as set forth in claim 1, wherein said controller includes a presence timer for measuring said elapsed time.

7. An improved flushing system as set forth in claim 1, wherein said controller includes a flushing timer for determining that said first duration has elapsed and that said second duration has elapsed.

8. An improved flushing system as set forth in claim 1, wherein said preselected time interval is established to be approximately fifty-one seconds.

9. An improved flushing system as set forth in claim 1, including adjustment means for adjusting said preselected time interval.

10. An improved flushing system as set forth in claim 1, wherein said first duration is less than said second duration; and a first volumetric flow of water produced upon the movement of said valve into said open position for said first duration is less than a second volumetric flow of water produced upon the movement of said valve into said open position for said second duration, said first volumetric flow for flushing a liquid waste and said second volumetric flow for

11. An improved flushing system as set forth in claim 1, wherein said first duration is established to be commensurate with an amount of time required to remove a liquid waste; and said second duration being established to be commensurate with an amount of time required to remove a solid waste.

12. An improved flushing system as set forth in claim 1, wherein said actuator is electrically operated.

13. An improved flushing system as set forth in claim 1, including means for adjusting said first duration and said second duration.

14. An improved flushing system as set forth in claim 1, including a reservoir communicating with the pressurized water line for assisting water from the pressurized water line in flushing the water closet.

15. An improved flushing system as set forth in claim 1, including an upstanding pipe communicating with the pressurized water line; and said upstanding pipe having a first diameter substantially greater than a second diameter of the pressurized water line enabling the flow of water received within said upstanding pipe to assist the flow of water from the pressurized water line in flushing the water closet.

16. An improved flushing system as set forth in claim 1, including a manual control means for allowing the person to select said first duration and said second duration of the flow of water.

17. An improved flushing system as set forth in claim 16, wherein said manual control means comprises a number one button and a number two button;

said number one button for allowing the person to select said first duration; and said number two button for allowing the person to select said second duration.

18. An improved flushing system as set forth in claim 16, wherein said manual control means provides a number one signal to said controller upon selection by the person of said first duration; and said manual control means provides a number two signal to said controller upon selection by the person of said second duration.

* * * * *

UNITED STATES PATENT AND TRADEMARK OFFICE

CERTIFICATE OF CORRECTION

PATENT NO. : 5,187,818

DATED : February 23, 1993

INVENTOR(S) : John P. Barrett, Sr. et al.

It is certified that error appears in the above-identified patent and that said Letters Patent is hereby corrected as shown below:

Column 4, line 34, after "diameter," insert --the first conduit diameter and the second conduit diameter do--.

Column 10, line 27, after "Q4" insert --. The drain pin 3 of the pyroelectric infrared sensor Q4--.

Column 12, line 11, after "the" (1st. occ.) insert --second duration, respectively, regardless of whether the--.

Column 13, line 37, delete "1" and insert therefore --18--.

Column 20, line 46, should read --flushing a solid waste.--.

Signed and Sealed this

Eleventh Day of January, 1994

Bruce Lehman

*Attest:*

BRUCE LEHMAN

*Attesting Officer*

*Commissioner of Patents and Trademarks*